US006264320B1

(12) United States Patent
Moriyama et al.

(10) Patent No.: US 6,264,320 B1
(45) **Date of Patent: *Jul. 24, 2001**

(54) INK-JET PRINTING METHOD AND APPARATUS

(75) Inventors: Jiro Moriyama, Kawasaki; Hiromitsu Hirabayashi, Yokohama; Hiroshi Tajika, Yokohama; Toshiharu Inui, Yokohama; Yutaka Kurabayashi, Tokorozawa; Hitoshi Sugimoto, Yokohama; Masao Kato, Yokohama; Minako Kato, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/597,716

(22) Filed: Feb. 12, 1996

(30) Foreign Application Priority Data

Feb. 13, 1995 (JP) ..... 7-023572
Feb. 1, 1996 (JP) ..... 7-016924

(51) Int. Cl.[7] ..... B41J 2/01

(52) U.S. Cl. ..... 347/101; 347/100; 347/96; 347/105

(58) Field of Search ..... 347/100, 101, 347/105, 96

(56) References Cited

U.S. PATENT DOCUMENTS

| | | | | |
|---|---|---|---|---|
| 4,313,124 | | 1/1982 | Hara | 346/140 R |
| 4,313,684 | * | 2/1982 | Tazaki et al. | 400/322 |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,538,160 | * | 8/1985 | Uchiyama | 346/140 |
| 4,558,333 | | 12/1985 | Sugitani et al. | 346/140 R |
| 4,576,867 | * | 3/1986 | Miyamoto | 428/342 |
| 4,608,577 | | 8/1986 | Hori | 346/140 R |
| 4,630,076 | | 12/1986 | Yoshimura | 346/140 |
| 4,694,302 | * | 9/1987 | Hacklemar et al. | 346/1.1 |
| 4,723,129 | | 2/1988 | Endo et al. | 346/1.1 |
| 4,740,796 | | 4/1988 | Endo et al. | 346/1.1 |
| 4,836,852 | * | 6/1989 | Knirsch et al. | 106/22 |
| 5,555,008 | * | 9/1996 | Stoffel et al. | 347/100 |
| 5,635,969 | * | 6/1997 | Allen | 347/96 |
| 5,898,443 | * | 8/1995 | Yoshino et al. | 347/19 |
| 6,102,537 | * | 8/2000 | Kato et al. | 347/101 |

FOREIGN PATENT DOCUMENTS

| | | | |
|---|---|---|---|
| 0589696 | | 3/1994 | (EP) . |
| 0633142 | | 1/1995 | (EP) . |
| 53-024486 | | 3/1978 | (JP) . |
| 54-043733 | | 4/1979 | (JP) . |
| 54-056847 | | 5/1979 | (JP) . |
| 55-150396 | | 11/1980 | (JP) . |
| 58-128862 | | 8/1983 | (JP) . |
| 59-123670 | | 7/1984 | (JP) . |
| 59-138461 | | 8/1984 | (JP) . |
| 60-071260 | | 4/1985 | (JP) . |
| 299971 | * | 7/1988 | (JP) . |
| 63-299971 | * | 12/1988 | (JP) . |
| WO8703363 | | 6/1987 | (WO) . |

* cited by examiner

*Primary Examiner*—John Barlow
*Assistant Examiner*—Manish Shah
(74) *Attorney, Agent, or Firm*—Fitzpatrick, Cella, Harper & Scinto

(57) ABSTRACT

In an apparatus to perform printing by ejecting an ink and a printing quality improving liquid for making a coloring agent in the ink insoluble or coagulated, reaction between the printing quality improving liquid and the coloring agent of the ink is certainly caused. Namely, after ejecting the printing quality improving liquid from a head, Bk ink, Y ink, M ink and C ink are ejected through heads within a given period, e.g. 500 msec. By this, the printing quality improving liquid may react with the coloring agent of the ink before penetrating into a printing medium to certainly make the coloring agent insoluble or coagulated.

30 Claims, 13 Drawing Sheets

INK-JET PRINTING METHOD AND APPARATUS

BACKGROUND OF THE INVENTION

1. Field of the Invention

The present invention relates to an ink-jet printing method and apparatus. More specifically, the invention relates to an ink-jet printing apparatus and an ink-jet printing method for performing printing by ejecting an ink and a printing quality improving liquid for making a component in an ink insoluble or coagulated, to a medium to be printed.

The present invention is applicable for all of devices or apparatuses employing a paper, a cloth, a non-woven fabric, an OHP sheet, and so forth, and even a metal as a printing medium. In concrete, the present invention is applicable for an office appliance, such as a printer, a copy machine, a facsimile machine and so forth, an industrial production machine or so forth.

2. Description of the Prior Art

Ink-jet printing systems have advantages of low noise, low running cost, easiness of down-sizing and providing color printing capability for the apparatus, and so forth, and have been widely used in a printer, a copy machine and so forth.

However, when an image is printed on a printing medium, such as a plain paper and so forth by such apparatus using the ink jet printing system, it is possible that water resistance of the printed image is insufficient. Also, in case of printing of color image, it is somewhat difficult to achieve both of high density image which may not cause feathering and an image which may not cause bleeding between adjacent colors. Therefore, it is often impossible to obtain high quality color image with high image fastness.

As a method to improve water resistance of the image, an ink containing color agent which is provided with water resistive property, has been put into practical use. However, water resistance of the image is still insufficient in many case. Further, in principle, the ink containing a water resistive coloring agent is an ink which is difficult to dissolve in the water when once dried. Therefore, such ink can easily cause plugging of ink-ejection openings in an ink-jet head. Also, a construction of an apparatus for preventing plugging of ink can be complicated.

On the other hand, in the prior art, there are large number of technologies for improving fastness of a printed medium. For example, in Japanese Patent Application Laid-open No. 24486/1978, there is disclosed a technology for fixing a dye to the medium by laking the dye through post-treatment of the dyed product to increase fastness of the dye on the medium.

Japanese Patent Application Laid-open No. 43733/1979 discloses a method of the ink jet printing system for performing printing employing two or more components which may enhance film forming performance by mutually contacting at normal temperature or upon heating. By this, mutually contacting respective components on the printing medium may form a printing product with a film firmly fixed on a printing medium.

Also, in Japanese Patent Application Laid-open No. 150396/1980, a method for applying water-proofing agent forming a lake with a dye after printing with a water soluble ink by ink-jet system, is disclosed.

In Japanese Patent Application Laid-open No. 128862/1983, an ink-jet printing method for printing a printing ink and printing quality improving liquid in overlapping manner with preliminarily identifying a position of an image to be printed is disclosed. In the disclosed method, the image is precedingly printed with the printing quality improving liquid in advance of printing by the printing ink, the printing quality improving liquid is applied in overlapping manner on the printing ink printed in advance, and the ink is applied in overlapping manner on the printing quality improving liquid in advance, then, the printing quality improving liquid is applied over the printing ink in overlapping manner.

However, in application of printing quality improving liquid to improve printing quality of printing with a conventional printing ink, it is typical to separately process the printing medium before printing or to perform a separate process after printing.

SUMMARY OF THE INVENTION

The inventors have implemented the conventionally proposed art. As a result, it has been found that while application of a printing quality improving liquid may improve printing quality (improvement of water-resistance) to a certain extent in comparison with an image for which the printing quality improving liquid is not applied, it requires devices for performing pre-treatment or post-treatment and further requires complicated pre-treatment or post-treatment. Therefore, it has judged that the conventionally proposed arts are impractical in view of efficiency of printing.

Therefore, the inventors have made extensive study under a premise of use of the printing quality improving liquid per se for further improving printing quality and for adapting the apparatus for high speed printing with achieving compact size.

In a process of study, the inventors have found that a condition up to physically integrating the ink and the printing quality improving liquid on the surface of the printing medium causes variation of the printing quality.

Therefore, the present invention has been worked out with focusing a new condition which has not been paid the attention in the prior art, by supposing new task which has not been recognized in the prior art.

In general, applying a large amount of printing quality improving liquid on the printing medium within a short period may cause feathering and bleeding between different colors to degrade reliability of the printed image. However, the present invention may provide a technical level beyond a level of such point concept.

The present invention was worked out in view of the above-mentioned problems. Therefore, it is an object of the present invention to provide an ink-jet printing apparatus and an ink-jet printing method which may cause certainly reaction of a coloring agent in an ink and a printing quality improving liquid to effectively make the coloring agent insoluble or coagulated to permit printing of high quality image with improved water resistance of a printing product.

Here, the printing quality means water-resistance of the printed product, printing density, prevention or decreasing of feathering and bleeding between different colors, and hue.

Another object of the present invention is to provide an ink-jet printing apparatus and an ink-jet printing method for generating ejection data of the ink and the printing quality improving liquid to certainly cause reaction between the coloring agent of the ink and the printing quality improving liquid.

A further object of the present invention is to provide an ink-jet printing apparatus and an ink-jet printing method, in which, when the printing quality improving liquid and ink are ejected from a printing quality improving liquid ejecting head and an ink ejection head to be contacted and mixed on a printing medium, the printing quality improving liquid and the ink are ejected at an ejection interval within a period, during which at least part of one of the printing quality improving liquid and the ink ejected at the earlier timing remains on the surface and whereby before one of the printing quality improving liquid and the ink penetrates into the printing medium, mixing of the printing quality improving liquid with the ink can be performed.

In a first aspect of the present invention, there is provided an ink-jet printing apparatus for performing printing on a printing medium employing an ink and a printing quality improving liquid for making the ink insoluble or coagulated, the apparatus comprising:

an ejection controller for ejecting the printing quality improving liquid and the ink on substantially the same position or adjacent positions for mutually contacting with each other on the printing medium, at different timing, a time interval between timing for ejection of the printing quality improving liquid and timing for ejection of the ink being set within a period during which at least part of one of the printing quality improving liquid and the ink ejected at earlier timing remains on a surface of the printing medium.

In a second aspect of the present invention, there is provided an ink-jet printing apparatus for performing printing on a printing medium employing an ink and a printing quality improving liquid for making the ink insoluble or coagulated, the apparatus comprising:

an ejection controller for ejecting the printing quality improving liquid and the ink at substantially the same position or adjacent positions for mutually contacting with each other, a time interval between timing for ejection of the printing quality improving liquid and timing for ejection of the ink being less than or equal to 2000 msec.

In a third aspect of the present invention, there is provided an ink-jet printing method for performing printing on a printing medium employing an ink and a printing quality improving liquid for making the ink insoluble or coagulated, the method comprising the step of:

ejecting the printing quality improving liquid and the ink at substantially same position or adjacent positions for mutually contacting with each other, a time interval between timing for ejection of the printing quality improving liquid and timing for ejection of the ink being less than or equal to 2000 msec.

In a fourth aspect of the present invention, there is provided an ink-jet printing method for performing printing by feeding an ink to a printing medium, comprising the steps of:

providing an ink ejecting portion for ejecting the ink and a printing quality improving liquid ejecting portion for ejecting a printing quality improving liquid which makes a coloring agent in the ink insoluble or coagulated;

generating one ejection data for the printing quality improving liquid ejecting portion on a basis of a plurality of ejection data for the ink ejecting portion for forming a unit pixel group consisted of a given number of pixels;

forming the unit pixel group by ejecting the ink and the printing quality improving liquid from the ink ejecting portion and the printing quality improving liquid ejecting portion, respectively on a basis of respective of the plurality of ejection data and the one ejection data.

In a fifth aspect of the present invention, there is provided an ink-jet printing method for performing printing on a printing medium employing an ink and a printing quality improving liquid for making the ink insoluble or coagulated, wherein a position to which the ink is ejected for forming a pixel and a position to which the printing quality improving liquid is ejected for making the ink insoluble or coagulated are differentiated from each other.

In a sixth aspect of the present invention, there is provided an ink-jet printing method for performing printing on a printing medium employing an ink and a printing quality improving liquid for making the ink insoluble or coagulated, the method comprising the step of:

ejecting the printing quality improving liquid and the ink at substantially same position or adjacent positions for mutually contacting with each other, a time interval between timing for ejection of the printing quality improving liquid and timing for ejection of the ink being less than or equal to a period during which the ink and the printing quality improving liquid can contact with each other in a condition that the ink and the printing quality improving liquid are liquid state.

In a seventh aspect of the present invention, there is provided an ink-jet printing method for performing printing on a printing medium employing an ink and a printing quality improving liquid for making the ink insoluble or coagulated, the method comprising the step of:

ejecting the printing quality improving liquid and the ink at substantially same position or adjacent positions for mutually contacting with each other, a time interval between timing for ejection of the printing quality improving liquid and timing for ejection of the ink being less than or equal to a period during which the ink and the printing quality improving liquid can contact with each other in a condition that the ink and the printing quality improving liquid have penetrated into the printing medium.

In an eighth aspect of the present invention, there is provided an ink-jet printing method for performing printing on a printing medium employing an ink and a printing quality improving liquid for making the ink insoluble or coagulated, the method comprising the step of:

ejecting the printing quality improving liquid and the ink at substantially same position or adjacent positions for mutually contacting with each other, a time interval between timing for ejection of the printing quality improving liquid and timing for ejection of the ink being less than or equal to a period during which the ink and the printing quality improving liquid can react and whereby the ink is retained on predetermined region of the printing medium.

In a ninth aspect of the present invention, there is provided an ink-jet printing method for performing printing on a printing medium employing an ink and a printing quality improving liquid for making the ink insoluble or coagulated, the method comprising the step of:

ejecting the printing quality improving liquid and the ink at substantially same position or adjacent positions for mutually contacting with each other, a time interval between timing for ejection of the printing quality improving liquid and timing for ejection of the ink being less than or equal to a period during which the ink and the printing quality improving liquid can be mixed on the printing medium.

In a tenth aspect of the present invention, there is provided an image forming system comprising:

an ink-jet printing apparatus for performing printing on a printing medium employing an ink and a printing quality improving liquid for making the ink insoluble or coagulated, the apparatus comprising:

an ejection controller for ejecting the printing quality improving liquid and the ink on substantially the same position or adjacent positions for mutually contacting with each other on the printing medium, at different timing, a time interval between timing for ejection of the printing quality improving liquid and timing for ejection of the ink being set within a period during which at least part of one of the printing quality improving liquid and the ink ejected at earlier timing remains on a surface of the printing medium; and a communication device for receiving image data to be used in the ink-jet printing apparatus from an external device.

In an eleventh aspect of the present invention, there is provided an image forming system comprising:

an ink-jet printing apparatus for performing printing on a printing medium employing an ink and a printing quality improving liquid for making the ink insoluble or coagulated, the apparatus comprising:

an ejection controller for ejecting the printing quality improving liquid and the ink on substantially the same position or adjacent positions for mutually contacting with each other on the printing medium, at different timing, a time interval between timing for ejection of the printing quality improving liquid and timing for ejection of the ink being set within a period during which at least part of one of the printing quality improving liquid and the ink ejected at earlier timing remains on a surface of the printing medium; and a supply device for supplying an image data to the ink-jet printing apparatus.

In a twelfth aspect of the present invention, there is provided an image forming system comprising:

an ink-jet printing apparatus for performing printing on a printing medium employing an ink and a printing quality improving liquid for making the ink insoluble or coagulated, the apparatus comprising:

an ejection controller for ejecting the printing quality improving liquid and the ink on substantially the same position or adjacent positions for mutually contacting with each other on the printing medium, at different timing, a time interval between timing for ejection of the printing quality improving liquid and timing for ejection of the ink being set within a period during which at least part of one of the printing quality improving liquid and the ink ejected at earlier timing remains on a surface of the printing medium; and a reading device for reading an original image to be printed by the ink-jet printing apparatus.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiments of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order not to unnecessarily obscure the present invention.

(First Embodiment)

Figure 1:
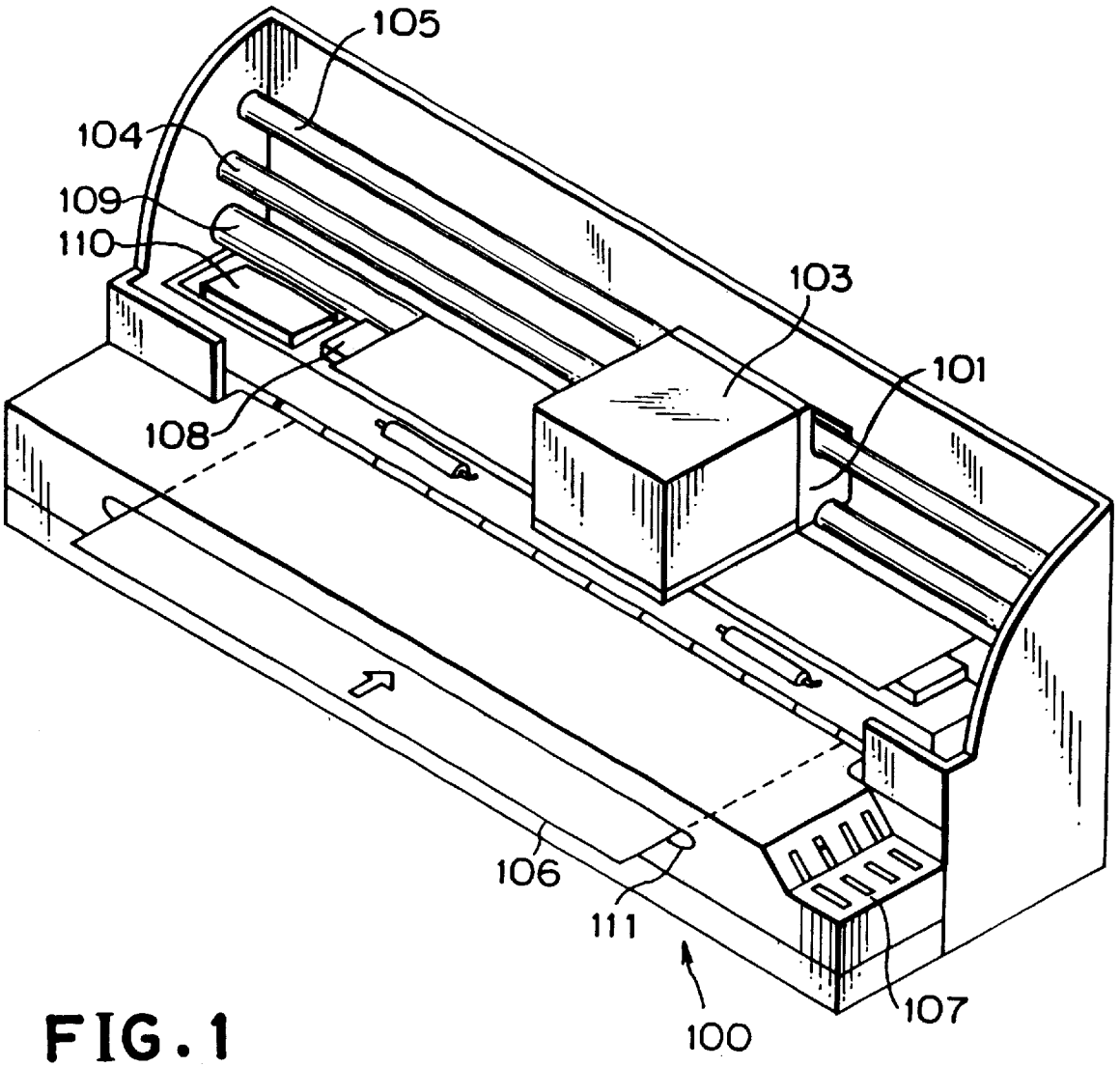
FIG. 1 is a perspective view of an ink-jet printing apparatus, to which the present invention is applicable.

FIG. 1 is a perspective view showing general structure of an ink jet printing apparatus of an embodiment of the present invention.

In an ink-jet printing apparatus 100, a carriage 101 slidably engages with two guide shafts 104 and 105 extending in parallel to each other. By this, the carriage 101 can be driven to shift along the guide shafts 104 and 105 by a drive motor and a driving force transmission mechanism (both are not shown), such as a belt and so forth, for transmitting the driving force of the drive motor. On the carriage 101, an ink-jet unit 103 having an ink-jet head portion and an ink tank as an ink container for storing an ink to be used in the head, is mounted.

The ink-jet unit 103 comprises a plurality of head portions for ejecting an ink or a printing quality improving liquid for improving water resistance or printing quality, and tanks as containers for storing the ink or the printing quality improving liquid to be supplied to the head portions. Namely, five head portions in total for respectively ejecting a black (Bk), magenta (M), yellow (Y) and a cyan (C) of four colors of inks, and, in addition for ejecting the above-mentioned printing quality improving liquid, and the tanks corresponding to respective head portions are mounted on the carriage 101, as the ink-jet unit 103. Each head and a corresponding tank are mutually detachable from each other so that when the ink or the printing quality improving liquid in the tank is spent out or so forth, only the emptied tank can be exchanged independently, as required. Also, it is of course possible to exchange only head as required. It should be noted that construction for attaching and detaching of the head portion and the tank is not restricted to the shown example, and the head and tank may also be formed integrally.

It should be noted that the head portion set forth above may be a part of the same head, or as in the shown embodiment, may be different head. In the discussion hereinafter, reference is made simply to head.

Further, "improvement of the printing quality" meant by a term "printing quality improving liquid", as discussed after in terms of one example, includes in the meaning to enhance density, chroma, degree of sharpness at an edge portion, dot diameter and so forth to be factors of the image quality, improvement of ink fixing ability and improvement of environment-resistance, such as water resistance, light resistance and so forth, namely, improvement of fastness or durability of the printed image.

A paper 106 as a printing medium is inserted through an insertion opening 111 provided at a front end portion of the apparatus, which is finally reversed in a feeding direction and fed to a lower portion of a scanning range of the carriage 101 by a feed roller 109. By this, from the heads mounted on the carriage 101, inks are ejected on the paper 106 supported on a platen 108 associating with scanning of the heads to perform printing in a printing region of the paper 106.

As set forth above, by alternately repeating printing in a width corresponding to a width of ejection opening array of the head and feeding of the paper 106, printing is performed on the overall paper 106. The paper 106 is then discharged from the front side of the apparatus.

In a region at left side end of a scanning stroke of the carriage 101, a recovery unit 110 which can be opposed to respective head of the carriage 101 from the lower side, is provided. By this, an operation for capping ejection openings of the respective heads in non-printing state and for sucking ink from ejection openings of respective heads can be performed. Also, a predetermined position at the left side end is set as a home position of the heads.

On the other hand, at a right side end of the apparatus, an operating portion 107 having switches and display elements are provided. The switches are used for turning ON and OFF a power source of the apparatus and setting of various printing modes, and so forth. The display elements serve for displaying various conditions.

Figure 2:
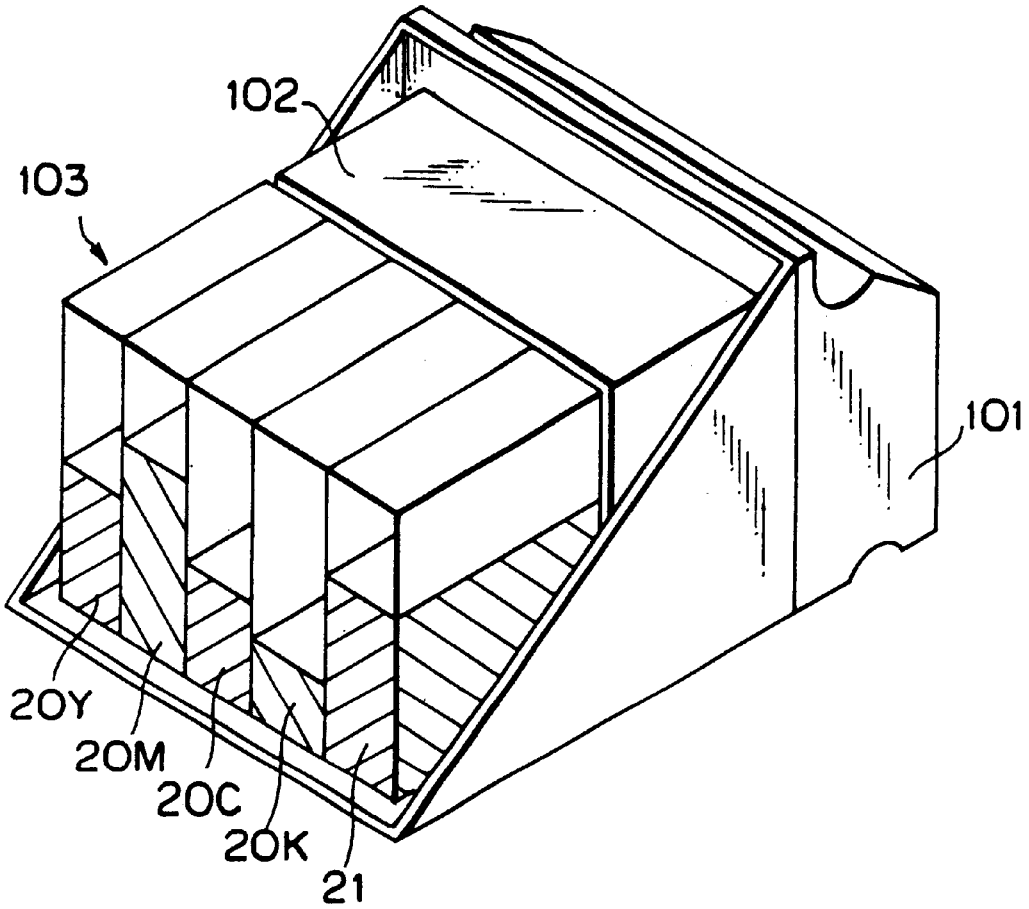
FIG. 2 is a perspective view of an ink-jet unit to be employed in the ink-jet printing apparatus of FIG. 1.

FIG. 2 is a general perspective view showing the ink-jet unit 103 explained with respect to FIG. 1. In the shown construction, respective tanks of black (Bk), magenta (M), yellow (Y) and cyan (C) color inks and the printing quality improving liquid (S) can be exchanged independently.

Namely, a head casing 102 for detachably loading each head independently, and the tank 20K for Bk ink, the tank 20C for C ink, the tank 20M for M ink, the tank 20Y for Y ink and the tank 21 for the printing quality improving liquid (S) are mounted on the carriage 101. In the head casing 102, heads 30K, 30C, 30M and 30Y (not shown) for respectively ejecting Bk, C, M and Y inks, and a head 31 (not shown) for ejecting the printing quality improving liquid are mounted. Each of heads 30K and 31 are provided with 160 ejection openings. On the other hand, each of the heads 30Y, 30M and 30C are provided with 48 ejection openings. Through respective ejection openings, 40 ng of inks or printing quality improving liquid are ejected. Respective tanks are connected to heads via connecting portions and supply inks. Also, respective tanks are formed of transparent material so that remaining level of the ink or the printing quality improving liquid therein may be checked.

It should be noted that structure of tanks may be such that the tank for the printing quality improving liquid is integrally formed with the tank for the Bk ink, or such that the tanks for the C, M, Y inks are integrally formed, in accordance with respective spending amount of the ink or the printing quality improving liquid.

Figure 3:
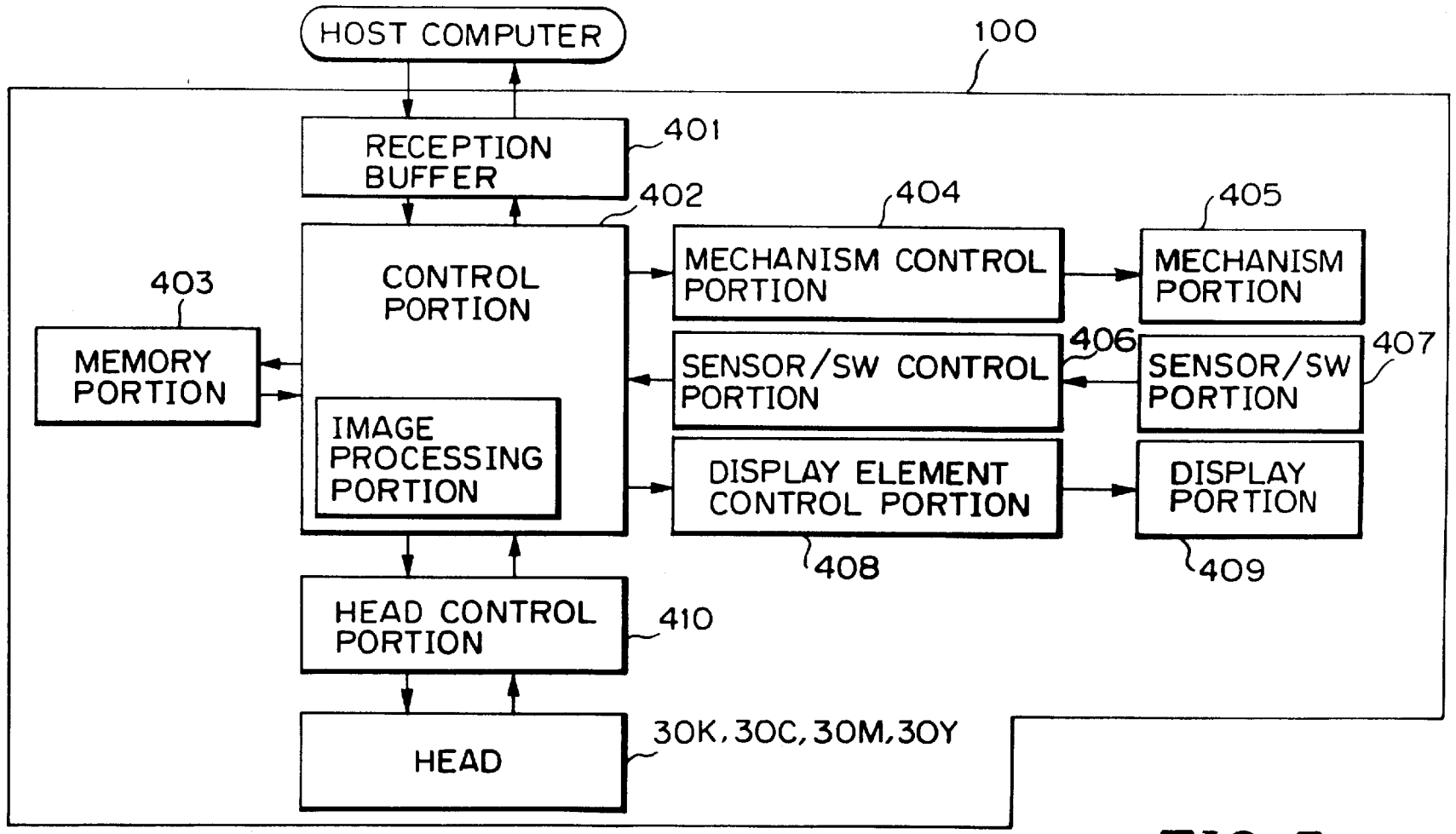
FIG. 3 is a block diagram showing a construction of a control system of the printing apparatus set forth above.

FIG. 3 is a block diagram showing a construction of a control system of the shown embodiment of the ink-jet printing apparatus.

From a host computer, data of character, image or the like to be printed (hereinafter referred to as an image data) is input to a reception buffer 401 of the printing apparatus 100. On the other hand, data for verifying if correct data is transmitted or data for notifying operating condition of the printing apparatus are transferred from the printing apparatus to the host computer. The data input to the reception buffer 401 is transferred to a memory portion 403 in a form of RAM and stored therein temporarily under control of the control portion 402 having a CPU. A mechanism control portion 404 drives a mechanical portion 405, such as a carriage motor or a line feed motor as a driving power source for the carriage 101 or the feed roller 109, and so forth (both seen from FIG. 1), under a command of the control portion 402. A sensor/SW control portion 406 feeds a signal from a sensor/SW portion 407 constituted of various sensors and SWs (switches), to the control portion 402. A display element control portion 408 controls a display of a display element portion 409 constituted of LEDs or liquid crystal display elements of display panel group. A head control portion 410 independently controls driving of respective heads 30K, 30C, 30M and 30Y according to a command from the control portion 402. On the other hand, the head control portion 410 also reads temperature information or so forth indicative of conditions of respective heads and transfers to the control portion 402.

In the control portion 402, an image processing portion which performs later-mentioned image processing is constructed.

Figure 4:
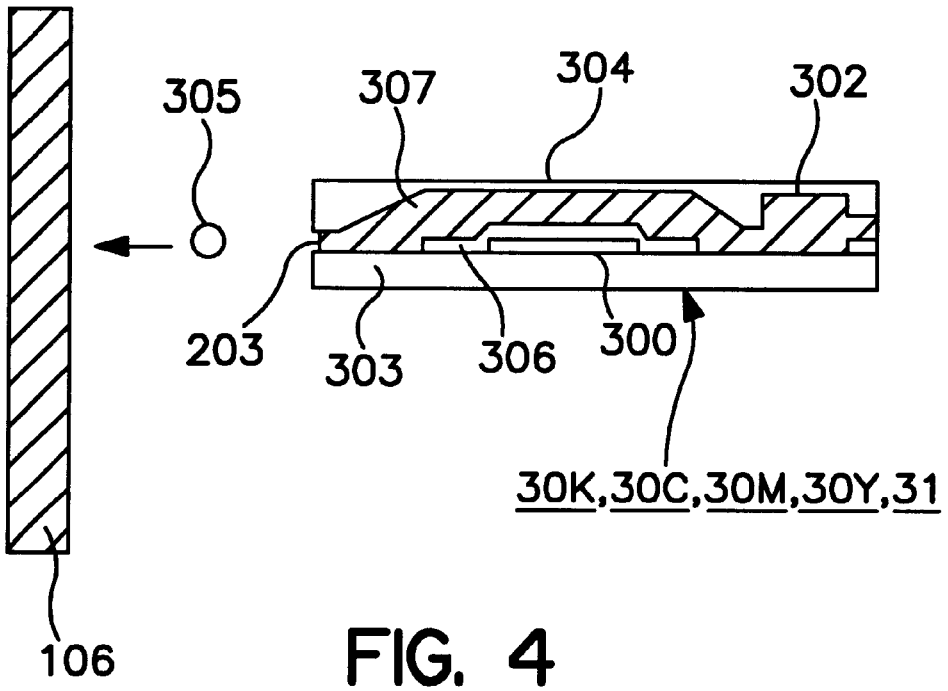
FIG. 4 is an enlarged section of a head to be employed in the ink-jet printing apparatus.

FIG. 4 is a diagrammatic section showing major portion of the head for ejecting the ink or the printing quality improving liquid as set forth above.

The head of the shown embodiment employs a system for ejecting the ink or the printing quality improving liquid through ejection openings 203 by arranging electrothermal transducers (heaters) 300 corresponding to respective ejection openings and applying drive signals to the heaters on a basis of printing information. A heater 300 is provided in each ink path or printing quality improving liquid path for heating independently of each other. A plurality of ejection openings 203 are aligned in a direction perpendicular to the sheet surface of the drawing. A pitch of arrangement of the ejection openings is approximately 70 $\mu$m to achieve 360 dpi of resolution.

The ink or printing quality improving liquid in the ink path or the printing quality improving liquid path as abruptly heated by heating of the heaters 300 generates a bubble by film boiling to eject ink droplet 305 or printing quality improving liquid droplet 305 toward the printing medium 106 to form character and/or image on the printing medium.

For each ejection opening, an ink path 307 or the printing quality improving liquid path 307 communicated with the ejection opening is provided. At the back side of the portion where the ink path 307 or the printing quality improving liquid path 307 are provided, a common liquid chamber 302 is provided for supplying ink or printing quality improving liquid for the respective ink paths or the respective printing quality improving liquid paths. In each ink path or each printing quality improving liquid path corresponding to each ejection opening 203, the electrothermal transducer, i.e. heater 300 for generating thermal energy to be utilized for ejecting a droplet of the ink or the printing quality improving liquid and electrode wiring for supplying power to the heater are provided. These heaters 300 and the electrode wirings are formed on a substrate 303 of silicon or the like by film formation technology. On the substrate 303, a protective layer 306 is formed for preventing the ink or the printing quality improving liquid from directly contacting with the heater. By stacking an upper plate 304 formed with partitioning walls, the ejection opening, the ink paths for the printing quality improving liquid paths and the common liquid chamber and so forth are formed. It should be noted that as a material of the upper plate, resin, glass or the like may be employed.

Such ink ejection system employing the heater is called a bubble jet system since it utilizes bubbles formed by supplying thermal energy in order to eject the droplet of the ink or the printing quality improving liquid.

Figure 5:
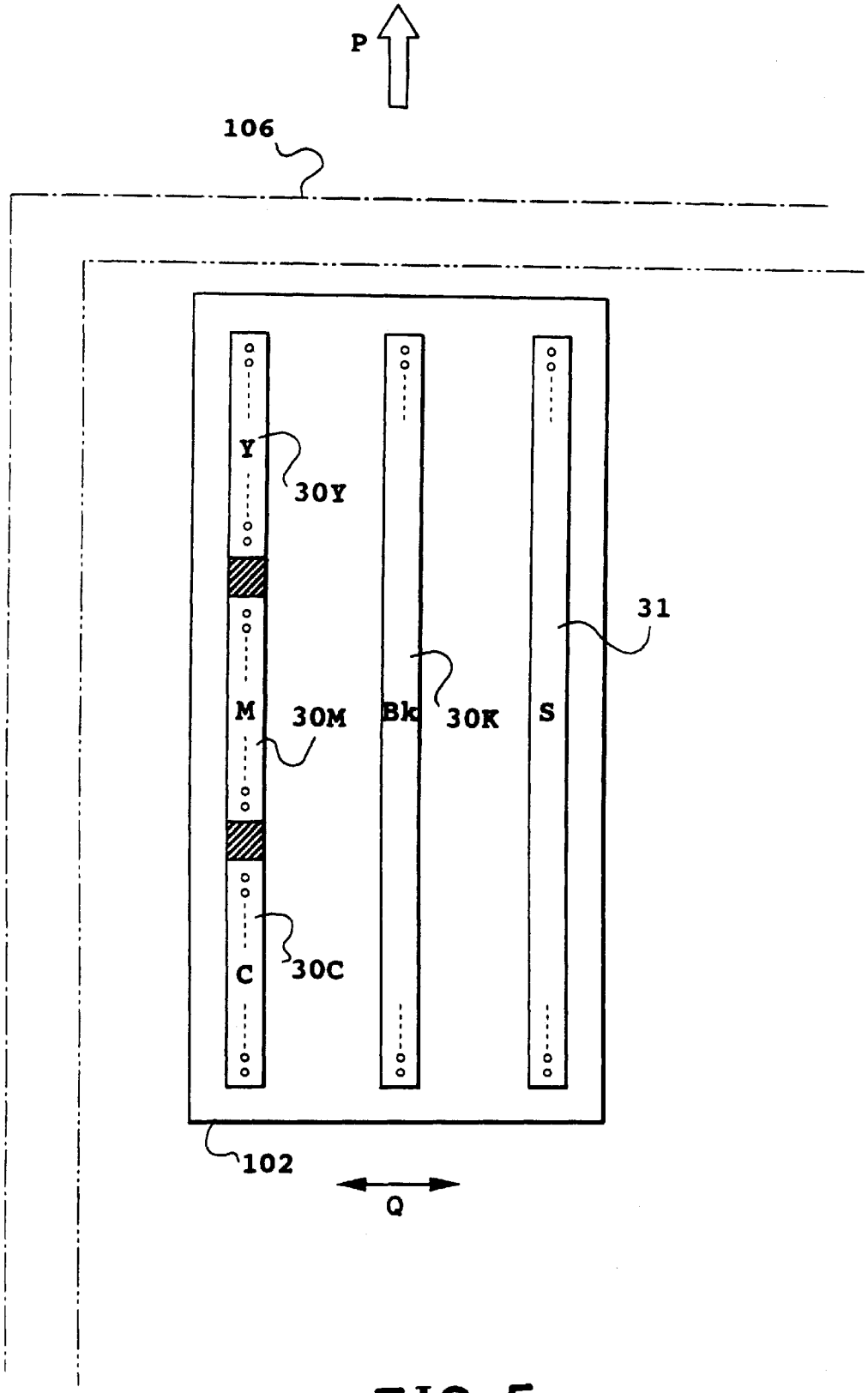
FIG. 5 is an illustration showing an arrangement of respective heads in the ink-jet printing apparatus set forth above.

FIG. 5 is an illustration showing an arrangement of the ejection openings in each head, and is a sight through illustration seeing the head unit 102 from the back side of the printing medium 106 through the printing medium in the apparatus shown in FIG. 1. On the other hand, two-dotted line in the printing medium represents a region which can be printed.

The printing medium 106 may shift in the direction of arrow P and the head unit 102 can shift in the direction of the arrow Q. Number of the ejection openings of the heads 31 and 30K are 160, respectively. On the other hand, the C, M, Y heads 30C, 30M and 30Y in integral structure are provided with 48 ejection openings, respectively. Also, the pitch of respective ejection openings in respective heads is approximately 70 $\mu$m. Further, mutual distances between the heads 30Y, 30M and 30C is for 8 pitches of the ejection opening pitch. Depending upon this space, partitioning walls are provided for avoiding mixing of adjacent inks, i.e. inks Y and M or inks M and C. Intervals in the direction of the arrow Q between the S head 31 and the Bk head 30K, the Bk head and C, M, Y heads 30C, 30M, 30Y is for 180 pitches of the ejection opening pitch. In any head, the ejection openings are arranged in alignment in the direction substantially perpendicular to the direction shown by the arrow Q. Also, the ejection openings on the respective lowermost ends of the integral C, M, Y heads, the Bk head and S head are adapted to pass the same position in shifting of the head unit 102.

Figure 6:
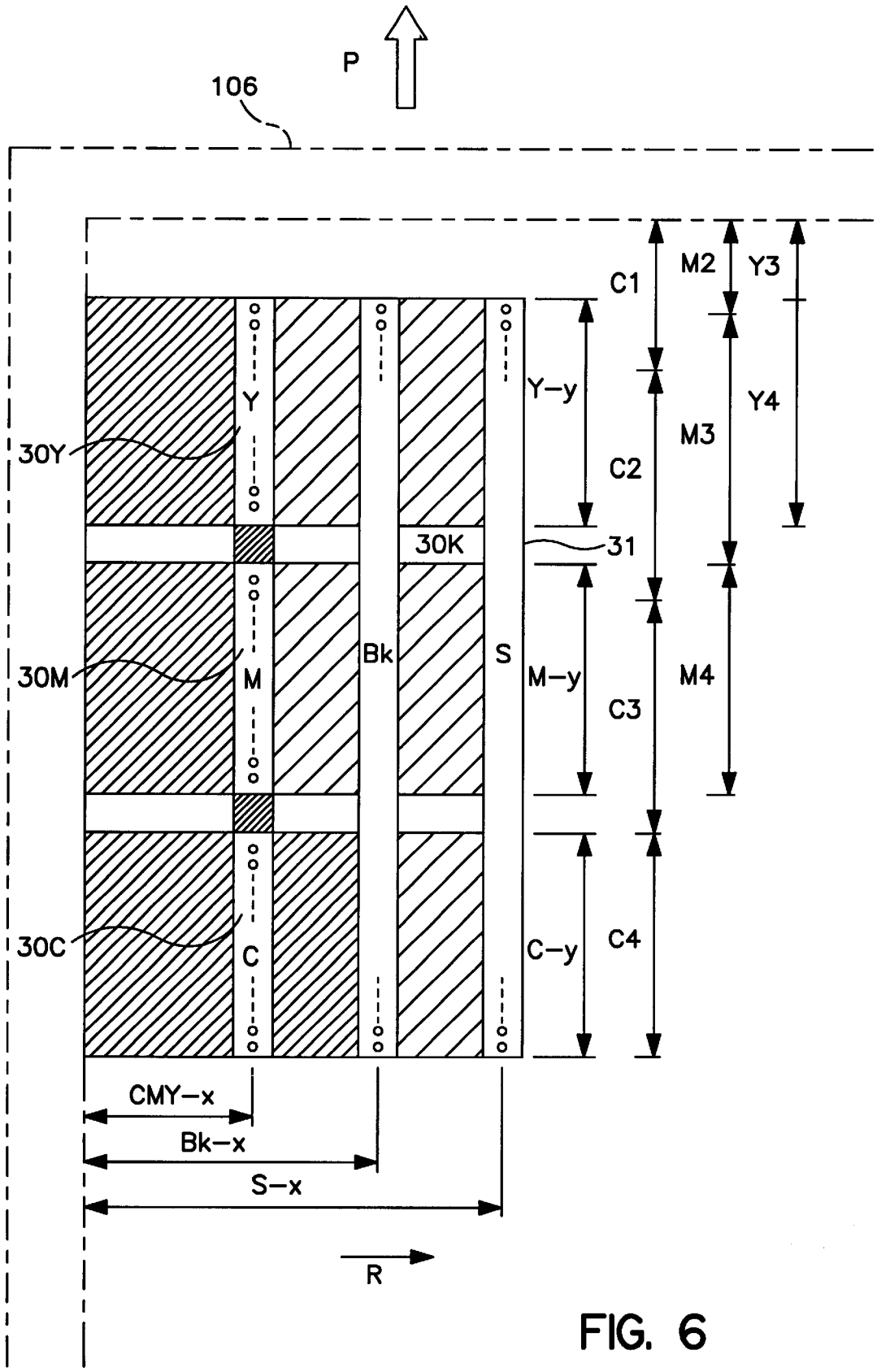
FIG. 6 is a diagrammatic illustration for explaining the first embodiment of a printing process according to the invention.

FIG. 6 is an explanatory illustration showing a printing process in one embodiment of the present invention.

When printing operation is started, the ink and the printing quality improving liquid are ejected to the printing medium 106 in accordance with print data. More specifically, to positions on the printing medium 106, which positions correspond to positions on the printing medium to which the inks of Bk, Y, M and C are to be ejected from the respective heads, the printing quality improving liquids are firstly ejected. Next, the Bk ink is ejected from the Bk head 30K. Further, the inks of Y, M and C are ejected from the Y head 30Y, the M head 30M and C head 30C, respectively after ejection of the Bk ink. By this, the printing quality improving liquid S and the Bk ink are firstly mixed with each other to become insoluble. Next, the printing quality improving liquid S and the respective Y, M, C inks are mixed with each other to become insoluble, respectively.

FIG. 6 shows a processes for a fourth cycle of main scanning of the respective heads mounted on the carriage.

Printing operation is performed only when respective heads are shifted toward right as shown by arrow R, and printing operation is not performed upon back scanning where the heads are shifted toward left. Also, with respect to each color of ink, printing is performed by scanning one time for the same printing region. Namely, printing is performed in one path and in one way.

In the drawings, lengths represented by C1 to C4, M2 to M4 and Y3, Y4 represent scanning region (width) for printing in (n)th scanning cycle (in an illustrated example, n=1, 2, 3, 4) of respective of the C head 30C, the M head 30M and the Y head 30Y. As can be clear from this, concerning the inks of Y, C and M, in the first scan at initiation of printing, ink ejection is performed only a part of the ejection opening group of the C head 30C to perform printing in a region of the width C1. It should be noted that, at this time, ejection is also performed for the scanning region of the width C1 through the S head 31 and K head 30K according to ejection data, as a matter of course. Also, in second and subsequent scanning cycles, the K head 30K performs ink ejection for the same region as the region where the C head 30C performs ejection, and the S head 31 performs ejection of the printing quality improving liquid for the regions where respective of the C, M, Y heads perform ejection, according to the ejection data.

In a second scanning cycle, the C head 30C performs ejection for the scanning region of a width C2. At the same time, the M head 30M performs ejection for the scanning region of a width M2. In this case, as can be clear from the drawings, for a part of the region (C1) where printing was performed by the C head 30C in the first scanning cycle, printing is performed by the M head 30M in overlapping manner (width M2).

In a third scanning cycle, the Y head 30Y performs ejecting for a region shown by Y3 (region Y3). Only on the fourth and subsequent scanning cycles, printing is performed utilizing all of the ejection openings of the C, M, Y heads.

In FIG. 6, the region printed by the fourth scanning cycle as set forth above is illustrated by the hatched area. Namely, from initiation of the fourth scanning cycle, the Y head 30Y performs ejecting for a region identified by CMY-x in a x direction (primary scanning direction) and by Y-y in a y direction (auxiliary scanning direction). The M head 30M performs ejecting for a region identified by CMY-x in the x direction and by M-y in the y direction. The C head 30C performs ejecting for a region identified by CMY-x in the direction x and by C-y in the y direction. The Bk head 30K performs ejecting for a region identified by Bk-y in the x direction and by c-y in the y direction.

Here, ejection from the S head 31 is performed for printing regions overlapping printing regions of respective inks in the primary scanning direction. As a result, the printing quality improving liquid for the Y ink is ejected in a region represented by S-x in the x direction and by Y-y in the y direction. The printing quality improving liquid for the M ink is ejected in a region represented by S-x in the x direction and by M-y in the y direction. With respect to the C and Bk inks, printing is performed for a region identified by S-x in the x direction and by C-y in the y direction.

A reason for ejecting the printing quality improving liquid only in the region overlapping with respective of Y, M, C, Bk inks is as follows. If the ink is ejected after a relatively long period has elapsed from ejection of the printing quality improving liquid, the ink may be ejected after the printing quality improving liquid has penetrated into the printing medium to cause difficulty in obtaining a sufficient effect of reaction by mixing of the printing quality improving liquid with the ink. Therefore, it is necessary to eject the printing quality improving liquid only in the region overlapping with respective inks in order to shorten a period elapsed form ejection of the printing quality improving liquid. Here, the driving frequency of the head is 8kHz, and distance between the S head and the respective Y, M, C heads is 360 pitches of the ejection opening pitch. Therefore, after ejection of the printing quality improving liquid, ink is ejected at 45 msec. Therefore, no problem is arisen for the reason set out below.

The inventors have clearly pointed out the effect of the printing quality improving liquid in terms of "improvement of water resistance" and "anti-bleeding property between the Bk ink and respective of the C, M, Y inks", as a result of study.

The study has been made, under a premise that an ejection speed at respective heads are the same, and that a distance between a head for ejecting the printing quality improving liquid and the printing medium and a distance between a head for ejecting the ink and the printing medium are the same, by varying a distance between the S head and respective heads of the Y, M, C heads, a distance between the S head and the K head, and driving frequency F of the respective heads and by performing ejection of the Bk ink after T1 msec from ejection of the printing quality improving liquid, and ejection of the Y, M, C inks after T2 (=T1×2) msec. to perform evaluation for the foregoing two items. Evaluation method for a water resistance is that, after dipping a printed product into the water, remaining ratio of density on the printed product was checked. As a result, when the remaining ratio of density is higher than or equal to 98%, judgement is made as good (O), when the remaining ratio of density of less than 98% and higher than or equal to 95%, judgement is made as acceptable (Δ), and otherwise, judgement is made as no good (x). Also, concerning anti-bleeding property, judgement is made based on visual observation. When degree of bleeding on the printing medium between Bk and C, M, Y is less than or equal to two times of the minimum resolution (about 70 μm), judgement is made as good (O), when less than or equal to six times of that, judgement is made as acceptable (Δ), and otherwise, judgement is made as no good (x).

Here, the evaluation of "acceptable (Δ)" and "no good (x)" is relatively severe so that practical printing quality can be obtained. Even in the case that the evaluation is "acceptable (Δ)" or "no good (x)", it is possible to obtain improvement of the pointing quality.

Ejection of the printing quality improving liquid was performed at 25% duty with respect to each pixel of Y, M, C, Bk. Reduction of an ejection amount of the printing quality improving liquid may reduce consumption of the printing quality improving liquid to result in lowering of the running cost. Furthermore, by reducing an ejection amount of the ink and the printing quality improving liquid, it can be expected an effect of reduction of magnitude of waving due to unevenness of the printing material.

Ejection volume of the respective inks and the printing quality improving liquid is about 80 pl in the Bk ink, about 40 pl in each of the Y, M, C inks and about 40 pl in the printing quality improving liquid. On the other hand, as the printing material, XX4024, Prover Bond, Gilber Bond which were normally used in copy machine or so forth, were used. Through the study set forth above, results shown in the following table were obtained.

TABLE 1

| Time Difference T2 (msec) | 45 | 100 | 200 | 500 | 1000 | 1500 | 2000 | 2500 |
|---|---|---|---|---|---|---|---|---|
| Water-Resistance | ○ | ○ | ○ | ○ | ○ | ○ | Δ | × |
| Bleeding | ○ | ○ | ○ | ○ | Δ | × | × | × |

From the foregoing table 1, it should be appreciated that, as a condition for further improving the water resistance in comparison with the conventional printing quality improving liquid, it is desirable to set the period T2 to be shorter than or equal to 2000 msec. It is further preferred to set the period T2 to be shorter than or equal to 1500 msec. for practical use and for obtaining stable image distribution. As a condition for effect on preventing the bleeding, the timing difference T2 less than or equal to 1000 msec. may be considered. In comprehensive sense, the time difference T2 less than or equal to 500 msec. is optimal.

In addition to bleeding between Bk and respective colors, feathering as characteristics with respect to a single color is variable depending upon the time difference. Feathering is caused by penetration of ink toward the not indented region on the surface of the printing medium due to physical property of the ink, and surface structure and physical property of the printing medium.

Here, depending upon time difference between ejection of the printing quality improving liquid to the printing medium and ejection of the ink. Shorter time difference results in lesser occurrence of the feathering. Therefore, improvement with respect to the feathering may be achieved by shortening the time difference.

This is because that during process of penetration of the first ejected printing quality improving liquid into the printing medium, by reacting with the ink before completely absorbed in the printing medium, the coloring agent becomes insoluble or is coagulated to prevent feathering from occurring.

For example, when only printing quality improving liquid is deposited on the overall region of the printing medium and the ink is ejected on the printing medium after completely drying the printing quality improving liquid, feathering is caused. This is true even when deposition of the printing quality improving liquid is not the overall region but only in the printing region. In contrast, when ink is ejected within 45 to 500 msec after deposition of the printing quality improving liquid on the printing medium, occurrence of feathering can be reduced in comparison with the case where the ink is ejected after drying of the printing quality improving liquid.

According to an experiment shown in the foregoing table 1, it is appreciated that hue of the ink ejected on the printing medium is also variable depending upon the period from timing of ejection of the printing quality improving liquid to timing of ejection of the ink. More specifically, in comparison with the case where the printing quality improving liquid is not employed, density of the deposited ink on the printed medium is enhanced and, in conjunction therewith, hue of the ink is also varied by adding the printing quality improving liquid. Variation of hue is substantially constant as long as T2 is shorter than or equal to 1000 msec. When T2 exceeds 1000 msec, hue may be varied in an extent of visually perceptible of difference of color depending upon an ejection time difference between the printing quality improving liquid and the ink. In concrete, a color difference ΔE at a portion where a portion printed at T2=45 msec and a portion printed at T2=1500 msec are adjacent to each other is greater than 1, whereas a color difference ΔE at a portion where a portion printed at T2=45 msec and a portion printed at T2=1000 msec are adjacent to each other is less than or equal to 1.

In view of this phenomenon, it is desirable that the ejection timing difference of the printing quality improving liquid and the ink is to be smaller than or equal to a predetermined value. More preferably, in order to prevent hue from varying, the ejection timing difference is constant in a range smaller than or equal to the predetermined value. In the shown experiment, the predetermined value is 1000 msec or less.

In addition to variation of color difference, printing density is also varied depending upon the ejection timing difference between the printing quality improving liquid and each color ink. Smaller timing difference from ejection of the printing quality improving liquid onto the printing medium to ejection of the ink results in higher printing density and higher printing quality, and greater timing difference results in lower printing density and lower sharpness to degrade printing quality.

This is because, by causing reaction between the printing quality improving liquid and the ink before the printing quality improving liquid has completely penetrated into the printing medium, the ink becomes insoluble or coagulated on a surface of the printing medium to stay on the surface in large proportion to make the printing density higher.

For example in comparison with the case where the printing quality improving liquid is deposited on the overall region of the printing medium and the ink is ejected on the printing medium after completely drying the printing medium on which the printing quality improving liquid is deposited, higher printing density can be obtained when the ink is ejected within 45 msec to 500 msec from deposition of the printing quality improving liquid onto the printing medium.

As set forth above, by ejecting the ink with a period shorter than or equal to a predetermined period after ejection of the printing quality improving liquid, improvement of water-resistance, lowering of bleeding to be caused between different colors of inks, and lowering of feathering can be achieved. Furthermore, by ejecting the ink at a constant timing difference with in the predetermined period from ejection of the printing quality improving liquid, printing with high density and uniform hue can be performed. More specifically, by improvement of water resistance, "a highly durable printed product" can be obtained, and by lowering of bleeding and feathering and by printing with high density and uniform hue, "high printing quality" can be obtained.

Here, the term "predetermined period" means a period during which, when ejecting the printing quality improving liquid and the ink to the same position on the printing medium at different timing, at least part of one of the printing quality improving liquid and the ink ejected at earlier timing is remained on the surface of the printing medium. For example, when the printing quality improving liquid is ejected to the printing medium, most of the printing quality improving liquid penetrates into the printing medium. On the other hand, part of the printing quality improving liquid is evaporated into the atmosphere. Therefore, the residual printing quality improving liquid on the surface of the printing medium is reduced according to expiration of time. Thus, the ink has to be ejected while the component of the printing quality improving liquid which contributes for reaction with the ink, is remained on the surface of the printing medium.

Furthermore, the constant period is preferred to cause reaction between the ink and the printing quality improving liquid under the same condition. In case that a portion where either of the ink or the printing quality improving liquid is in higher ratio than other portion, printing density of such portion may be differentiated from other portion.

Here, study has been made under the premise that ejection speeds are the same in respective heads. Also, the study has been made under than condition where a distance between the head for printing quality improving liquid and the printing medium, and a distance between the head for the ink and the printing medium are the same.

In general when the ejection speed of respective heads or the distances between respective heads and the printing medium are differentiated, the difference of the ejection timing and the difference of hitting timing become not equal. In such case, the hitting timing is essential.

In addition, the reaction between the printing quality improving liquid and the ink can be a reaction between one droplet of the printing quality improving liquid and one droplet of the ink on a pixel, or between one droplet of the printing quality improving liquid and two droplets of the ink. Also, it is possible that reaction is caused between two droplets of the printing quality improving liquid and two droplets of the ink. While such variety of cases are considered, the timing difference is ideally a timing difference between a firstly hitted printing quality improving liquid to a lastly hitted ink, or a firstly hitted ink to a lastly hitted printing quality improving liquid. However, with taking the timing difference between the firstly hitted printing quality improving liquid and a succeedingly hitted ink, or the firstly hitted ink to a succeedingly hitted printing quality improving liquid, effect can still be obtained. This is because that by reaction of the firstly hitted printing quality improving liquid and the succeedingly hitted printing quality improving liquid to slow down penetration of the printing quality improving liquid or the ink into the printing medium to make the residual amount of the ink and the printing quality improving liquid large.

While it is desirable to feed a printing data from a host system or so forth continuously during printing operation, it is possible to cause a necessity to wait the data to be fed at the mid-way of printing. In such case, for example, it is possible to use the printing quality improving liquid only for the portion corresponding to the C ink, and in subsequent scan, to eject the printing quality improving liquid corresponding to the M ink and/or the Y ink. However, it is possible that the M ink and/or the Y ink is ejected when the waiting period is elapsed after ejection of the printing quality improving liquid. By this, non-uniform timing difference can be caused. Also, when a breadth of a region to be printed in one scanning cycle is varied, it is possible that the timing difference between ejection of the printing quality improving liquid and ejection of the ink is differentiated. For example, between the case where printing is performed for narrow portion in the primary scanning direction and the case where printing is performed for wide portion, the timing difference between ejection of the printing quality improving liquid and ejection of the ink can be differentiated.

On the other hand, when the printing method as illustrated in FIG. 6 is employed, for example, if the printing quality improving liquid is ejected only portion corresponding to the C ink to lower ejection frequency, unevenness of used ejection openings and increasing of use frequency of specific ejection openings are caused to be disadvantageous in comparison with the case where the printing quality improving liquid is ejected for the portions respectively corresponding to Y, M, C.

In the shown embodiment, the timing difference between ejection of the printing quality improving liquid and ejection of the ink is set to be within the predetermined period, and to be constant, set forth above. In order to realize this, printing of the current scanning cycle is performed after fixing the printing data of one scanning cycle by transferring of all data for the one scanning cycle from the host system. In addition to this, in advance of ink ejection of the respective of Y, M. C. Bk inks to a region to be printed in the current scan, the printing quality improving liquid is ejected at the positions where the respective inks are ejected.

More specifically, to a position corresponding to an ejecting position of the Y ink on the printing medium, the printing quality improving liquid is ejected in advance of the same scan, to a position corresponding to an ejecting position of the M ink on the printing medium, the printing quality improving liquid is ejected in advance of the same scan, to a position corresponding to an ejecting position of the C ink on the printing medium, the printing quality improving liquid is ejected in advance of the same scan, and to a position corresponding to an ejecting position of the Bk ink on the printing medium, the printing quality improving liquid is ejected in advance of the same scan.

In the shown embodiment, since the C ink and the Bk ink are ejected in the same scanning cycle, the printing quality improving liquid is ejected to the positions where the C ink and the Bk ink are ejected in advance but in the same scanning cycle. Differently from this, when the Bk ink and the M ink are to be ejected to the same scanning region, the printing quality improving liquid is ejected to the positions where the Bk ink and the M ink are ejected in advance but in the same scanning cycle.

As set forth above, while the printing quality improving liquid is ejected in advance of ejection of the ink to the same position to which the ink is ejected. However, through experiment discussed above, it has been found that a certain effect can be obtained even when printing quality improving liquid is not ejected for all of the positions to which the ink is ejected and thus the ejection duty cycle of the printing quality improving liquid is lowered than the that of ink ejection. Therefore, by preparing independent and mutually distinct four kinds of masks for respective data of Y, M, C, Bk inks, an ejection data of the printing quality improving liquid may be generated for more effectively using the printing quality improving liquid.

Figure 7A:
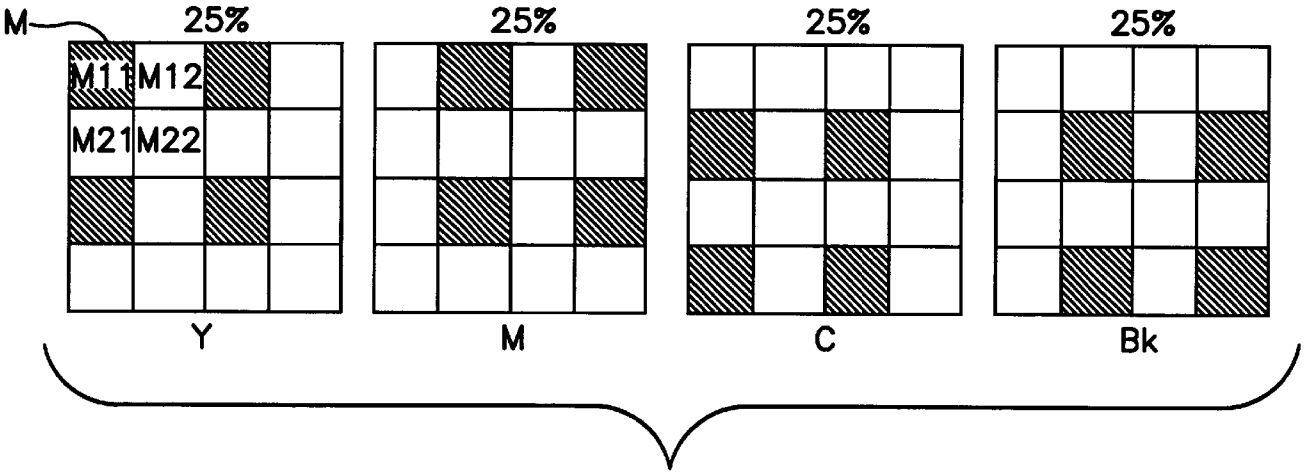
FIGS. 7A and 7B are illustrations showing concepts of printing quality improving liquid ejection data generating mask for respective inks.
Figure 7B:
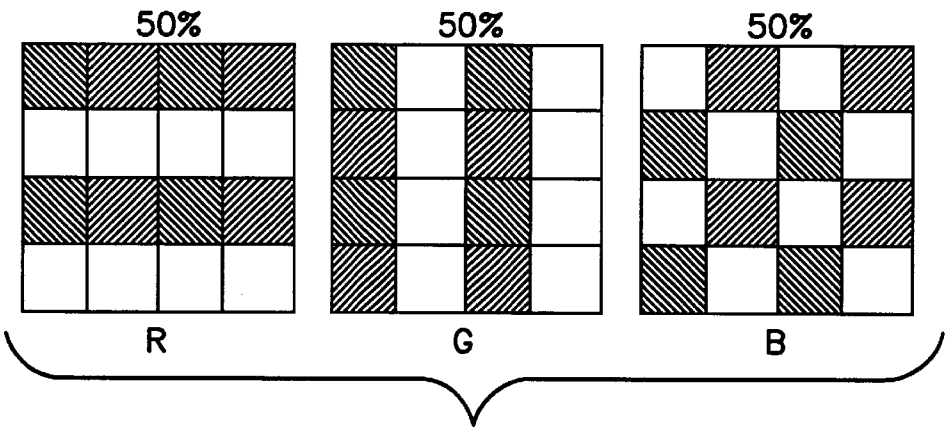

FIGS. 7A and 7B are diagrammatic illustrations showing masks for generating printing quality improving liquid ejection data of each ink. FIG. 7A shows the masks for generating printing quality improving liquid ejection data for respective of Y, M, C, Bk inks, and FIG. 7B shows the masks for generating the printing quality improving liquid ejection data for secondary colors, i.e. R (red), G (green) and B (blue). It should be noted that here, the minimum square represents a data corresponding to one pixel.

The shown masking process is a process for the case where the ejection duty of respective colors are 100% for solid printing. As a result of mask, only portions shown in black in FIGS. 7A and 7B become the ejection data of the printing quality improving liquid. Consequently, with respect to respective colors of Y, M, C, Bk inks, the printing quality improving liquid may be ejected with the ejection duty of 25%.

In more concrete discussion, a matrix M of 2×2 is the base of the mask. Namely, in the matrix M, M11 (left upper) is a position for setting data for the printing quality improving liquid corresponding to the Y ink, M12 (right upper) is a position for setting data for the printing quality improving liquid corresponding to the M ink, M21 is a position for setting data for the printing quality improving liquid corresponding to the C ink and M22 (right lower) is a position for setting data for the printing quality improving liquid corresponding to the Bk ink. For example, the data for the printing quality improving liquid corresponding to the Y ink is set at the position of M11, if the Y ink ejection data is present at any one of M11, M12, M21 and M22 in the matrix M. In other words, the foregoing matrix of 2×2 corresponds to 2×2 of pixels, and when the Y ink is ejected for at least one of these pixels, the printing quality improving liquid is ejected to the pixel corresponding to the M11 in advance of ejection of the Y ink.

Similarly, data for the printing quality improving liquid for the M ink is set corresponding to the position of M12, data for the printing quality improving liquid for the C ink is set corresponding to the position of M21, and data for the printing quality improving liquid for the Bk ink is set corresponding to the position of M22.

In the case that a masking process for the primary color Y, M, C is applied to R, G, B as secondary color, the process becomes as illustrated in FIG. 7B.

Even in this case, it is maintained to eject the printing quality improving liquid in 25% duty relative to respective of the Y, M, C color inks. For example, the data for the printing quality improving liquid corresponding to R is generated by providing mask for setting the data for the printing quality improving liquid only at the positions of M11 and M12. The data for the printing quality improving liquid corresponding to G and B are generated in the similar manner.

In this case, as set forth above, the positions for ejecting the printing quality improving liquid corresponding to respective of the Y, M, C inks are differentiated by the mask, even for the secondary color, the printing quality improving liquid will never be ejected to the same position in the plurality of times and ejected in uniformly distributed manner. As a result, even for printing in secondary color, the printing quality improving liquid ejection at 25% duty relative to respective primary color is held unchanged. Therefore, a mixing duty of the printing quality improving liquid and the ink can be uniform either in the primary color or the secondary color. In other words, the logical product of the printing quality improving liquid ejection data generation mask corresponding to respective of Y, M, C, Bk colors becomes zero. Namely, these masks become never overlapping mask.

In order to make the data for the printing quality improving liquid corresponding to respective color uniform, it becomes necessary to set the ejection duty for the S data to be less than or equal to 25%. This is to make the printing quality improving liquid ejection data uniform for four colors, i.e. Y, M, C, Bk. Assuming that ink is only three colors of Y, M and C, the ejection duty of the printing quality improving liquid may be set at less than or equal to $(1/3)\times 100$ (%).

Here, while there is illustrated the most typical manner to make the duty of respective masks for a plurality of color inks uniform, if it is desired to enhance an effect of the printing quality improving liquid for the Y ink, for example, the ejection duty of the printing quality improving liquid corresponding to the Y ink may be set higher than that corresponding to the remaining colors. For example, the printing quality improving liquid ejection duties may be set at 50% for the Y ink, 12.5% for the M ink, 12.5% for the C ink and 25% for the Bk ink.

The foregoing masking process and so forth may be realized by a printing quality improving liquid ejection data generation circuit comprising a simple logic circuit and a software for arithmetic process, for example. In such case, the ejection data of Y, M, C or Y, M, C, Bk temporarily stored in a memory, are arithmetically processed employing the mask for generating the data for the printing quality improving liquid to generate the data for the printing quality improving liquid in real time.

The printing quality improving liquid ejection data generating circuit is constructed in the head control portion 410 (see FIG. 3) to generate the data for the printing quality improving liquids to drive the S head at substantially the same timing to printing operation of the head in response to the Y, M, C, Bk data fed to the head control portion by a command of the control portion 402. Therefore, it is not necessary to newly provide a memory for the ejection data of the S head.

The inks and the printing quality improving liquid used in the shown embodiment are obtained as follows.

| Y (Yellow) Ink | |
|---|---|
| Glycerine | 5.0 wt. % |
| Thiodiglycol | 5.0 wt. % |
| Urea | 5.0 wt. % |
| Isopropyl Alcohol | 4.0 wt. % |
| Acetirenol EH (Kawa-ken Chemical) | 1.0 wt. % |
| Dyestuff, C.I. Direct Yellow 142 | 2.0 wt. % |
| Water | 78.0 wt. % |

| M (Magenta) Ink | |
|---|---|
| Glycerine | 5.0 wt. % |
| Thiodiglycol | 5.0 wt. % |
| Urea | 5.0 wt. % |
| Isopropyl Alcohol | 4.0 wt. % |
| Acetirenol EH (Kawa-ken Chemical) | 1.0 wt. % |
| Dyestuff, C.I. Direct Acid Red 289 | 2.5 wt. % |
| Water | 77.5 wt. % |

| C (Cyan) Ink | |
|---|---|
| Glycerine | 5.0 wt. % |
| Thiodiglycol | 5.0 wt. % |
| Urea | 5.0 wt. % |
| Isopropyl Alcohol | 4.0 wt. % |
| Acetirenol EH (Kawa-ken Chemical) | 1.0 wt. % |
| Dyestuff, C.I. Direct Blue 199 | 2.5 wt. % |
| Water | 77.5 wt. % |

| Bk (Black) Ink | |
|---|---|
| Glycerine | 5.0 wt. % |
| Thiodiglycol | 5.0 wt. % |
| Urea | 5.0 wt. % |
| Isopropyl Alcohol | 4.0 wt. % |
| Dyestuff, C.I. Food Black 2 | 3.0 wt. % |
| Water | 78.0 wt. % |

| S Printing quality improving liquid | |
|---|---|
| Polyaryl Amine Hydrochloride | 5.0 wt. % |
| Benzalkonium Chloride | 1.0 wt. % |
| Diethylene Glycol | 10.0 wt. % |
| Acetirenol EH (Kawa-ken Chemical) | 0.5 wt. % |
| Water | 83.5 wt. % |

As set forth above, Acetirenol EH as a surfactant is added to the Y, M, C inks at 1.0% to increase penetrating ability the printing medium. Therefore, the Y, M, C inks have an advantage in fixing ability to the printing medium in comparison with the Bk ink. On the other hand, the Bk ink has low penetrating ability but shows high optical density and high sharpness of an edge in a printed image. Therefore, the Bk ink is suitable for printing a character and a line. Acetirenol EH is added to the printing quality improving liquid at 0.5% to slightly increase the penetrating ability.

In mixing of the printing quality improving liquid and the ink as set forth above, in the present invention, as a result of mixing of the printing quality improving liquid and the ink on the printing medium or at a position penetrating the printing medium in a certain magnitude, as the first stage of reaction, low molecular weight component or cation type oligomer in the cation type substance contained in the printing quality improving liquid, and the water soluble dye having anion type group contained in the ink cause association by ionic interaction to separate from solution phase at a moment.

Next, as the second stage of reaction, an association body of the above-mentioned dye and low molecular weight cation type substance or cation type oligomer is absorbed by high molecular weight components included in the printing quality improving liquid. Therefore, the coagulated body of the dye becomes further greater in size to become difficult to penetrate into the gap between the fiber of the printing medium. As a result, only the liquid portion resulting from solid/liquid separation penetrates into the printing paper, both of printing quality and sensibility can be achieved. At the same time, viscosity of the coagulated body formed of the low molecular weight component of the cation substance or cation type oligomer, anion type dye and cation type substance is increased so as not to move according to movement of the liquid medium. Therefore, even when the adjacent ink dots are formed with different colors as in formation of a full color image, the color may not be mixed to each other. Therefore, bleeding is not caused. Also, since the coagulated body is essentially water insoluble, the moisture resistance of the formed image becomes complete. Also, color fastness to light of the formed image can be improved by the shielding effect of the polymer.

A word "insoluble" or "coagulate" used in this specification means a function in which a coloring agent, such as the dye and the pigment, is made insoluble or coagulate, and means a phenomenon only in the first stage, for one example, and phenomenon including both of the first and second stages, in another example.

On the other hand, in implementation of the present invention, since it is unnecessary to use cation high molecular substance having large molecule or polyvalent metal, or even when it is necessary to use such cation high molecular substance having large molecule or polyvalent metal salt, there are merely used auxiliary, the amount of use can be minimized. As a result, a problem of lowering of the color development of dye to be encountered when attempt is made to obtain the moisture resistant effect using the conventional cation type high molecular substance or polyvalent metal salt, can be avoided as another effect of the present invention.

It should be noted that the kind of the printing medium is not specified in implementation of the present invention, and conventionally used plain paper, such as copy paper, bond paper and so forth can be suitably used. Of course, a coated paper specially prepared for ink-jet printing, transparent film for OHP and so forth may also be used suitably. Also, general wood free paper, glossy paper and so forth may also used suitably.

Ink usable for carrying out the present invention should not be limited only to dyestuff ink, and pigment ink having pigment dispersed therein can also be used. Any type of the printing quality improving liquid can be used, provided that pigment is aggregated with it. The following pigment ink can be noted as an example of pigment ink adapted to cause aggregation by mixing with the treatment liquid A1 previously discussed. As mentioned below, yellow ink Y2, magenta ink M2, cyan ink C2 and black ink K2 each containing pigment and anionic compound can be obtained.

[Black ink K2 ]

The following materials are poured in a batch type vertical sand mill (manufactured by Aimex Co.), glass beads each having a diameter of 1 mm is filled as media using anion based high molecular weight material P-1 (aqueous solution containing a solid ingredient of styrene methacrylic acid ethylacrylate of 20% having an acid value of 400 and average molecular weight of 6000, neutralizing agent: potassium hydroxide) as dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

| (Composition of carbon black dispersing element) | |
|---|---|
| • P-1 aqueous solution (solid ingredient of 20%) | 40 parts |
| • carbon black Mogul L (manufactured by Cablack Co.) | 24 parts |
| • glycerin | 15 parts |
| • ethylene glycol monobutyl ether | 0.5 parts |
| • isopropyl alcohol | 3 parts |
| • water | 135 parts |

Next, the thus obtained dispersing element is sufficiently dispersed in water, and black ink K2 containing pigment for ink jet printing is obtained. The final product has a solid ingredient of about 10%.

[Yellow ink Y2 ]

Anionic high molecular P-2 (aqueous solution containing a solid ingredient of 20% of stylen-acrlylic acid methyl methaacrylate having an acid value of 280 and an average molecular weight of 11,000, neutralizing agent: diethanolamine) is used as a dispersing agent and dispersive treatment is conducted in the same manner as production of the black ink K2 whereby yellow color dispersing element having a weight-average grain size of 103 nm is produced.

| (composition of yellow dispersing element) | |
|---|---|
| • P-2 aqueous solution (having a solid ingredient of 20%) | 35 parts |
| • C. I. pigment yellow 180 (tradename: Nobapalm yellow PH-G, manufactured by Hext Co.) | 24 parts |
| • triethylen glycol | 10 parts |
| • diethylenglycol | 10 parts |
| • ethylene glycol monobutylether | 1.0 parts |
| • isopropyl alcohol | 0.5 parts |
| • water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan ink C2 ]

Cyan colored-dispersant element having a weight-average grain size of 120 nm is produced using anionic high molecular P-1 as dispersing agent, and moreover, using the following materials by conducting dispersing treatment in the same manner as the carbon black dispersing element.

| (composition of cyan colored-dispersing element) | |
|---|---|
| • P-1 aqueous solution (having solid ingredient of 20%) | 30 parts |
| • C. I. pigment blue 153 (trade name: Fastogen blue FGF, manufactured by Dainippon Ink And Chemicals, Inc.) | 24 parts |
| • glycerin | 15 parts |
| • diethylenglycol monobutylether | 0.5 parts |
| • isopropyl alcohol | 3 1parts |
| • water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta ink M2 ]

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

| (composition of the magenta colored dispersing element) | |
|---|---|
| • P-1 agueous solution (having a solid ingredient of 20%) | 20 parts |
| • C. I. pigment red 122 (manufactured by Dainippon Ink And Chemicals, Inc.) | 24 parts |
| • glycerin | 15 parts |
| • isopropyl alcohol | 3 parts |
| • water | 135 parts |

Magenta ink M2 for ink jet printing and having pigment contained therein is obtained by sufficiently dispersing the magenta colored dispersing element in water. The final product of ink has a solid ingredient of about 9.2%.

Figure 8:
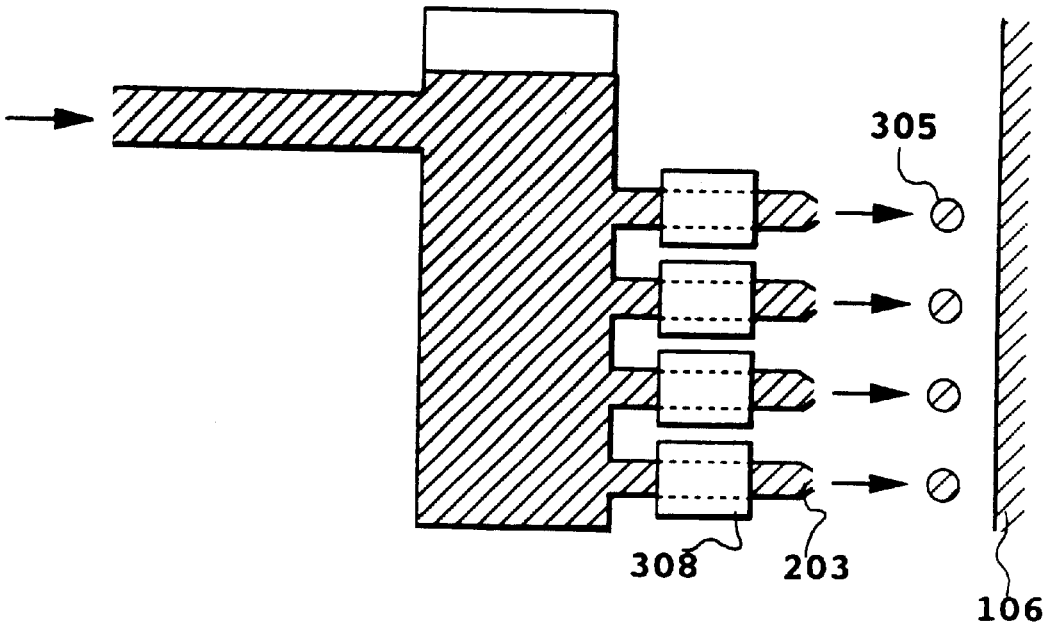
FIG. 8 is a diagrammatic illustration showing a construction of an ink-jet head by other system.

It should be noted that while the shown embodiment employs the head employing the electrothermal transducer as the head for ejecting the ink and the printing quality improving liquid, the head to be employed in not specified to the shown one. For example, a head employing electromechanical transducer element as shown in FIG. 8 may also be employed. here, 308 is a piezoelectric element as the electromechanical transducer.

(Second Embodiment)

While the foregoing first embodiment has been discussed in terms of application of the present invention for color printing mode, the present invention is applicable for monochrome printing using only black ink, in view of improvement of water resistance, improvement of feathering, enhancement of printing quality with high density and uniform hue.

In concrete, in FIG. 6, in the case that printing is performed with omitting the heads for Y, M, C to construct the head unit with only two heads for the printing quality improving liquid and Bk ink, respectively having 160 ejection openings, at first, the printing quality improving liquid is ejected and then the Bk ink is ejected. Even in this case, an effect of the ejection timing difference of the printing quality improving liquid and the Bk ink is equivalent to the foregoing first embodiment.

(Third Embodiment)

In the first embodiment, a data for the printing quality improving liquid corresponding to the Y ink, for example, is a data for ejecting corresponding to only pixel of M11. Namely among ejection data corresponding to 2×2 of pixels in question, process is performed so that the printing quality improving liquid for the pixel corresponding to M11 is ejected when the ejection data of the Y ink is present at any one of the relevant 2×2 of pixels. Similar process is performed with respect to each of M, C and Bk. However, application of the present invention is not limited to this process, and can be the following process.

With respect to the Y ink, for example, when the ejection data of the Y ink is present for all of the pixels in the relevant 2×2 pixels, process is performed for ejecting the printing quality improving liquid to the pixel corresponding to M11. Similar process is performed for each of M, C and Bk ink.

With this process, an ejection amount of the printing quality improving liquid can be further reduced. Such process may be taken depending upon an intended effect of the printing quality improving liquid. Reduction of ejection amount of the printing quality improving liquid results in reduction of consumption of the printing quality improving liquid to lower running cost. In addition, reduction of the ejection amount of the printing quality improving liquid may reduce the printing quality improving liquid to be deposited on the printing medium to reduce waving of the printing medium due to unevenness of the printing medium.

Furthermore, depending upon a desired effect of the printing quality improving liquid, with respect to the Y ink, for example, it is possible to eject the printing quality improving liquid to a pixel corresponding to M11 only when the ejection data of the Y ink is present in at least two (=N1) positions of M11. M12, M21 and M22. It is also possible to set N1=3. The same is true for M, C and Bk. These are all design matters adapting to the intended printing characteristics.

It should be noted that while the foregoing discussion has been given with employing 2×2 of matrix as the matrix for generating the data for the printing quality improving liquid, the present invention should not be specific to the shown matrix. For instance, in case of three inks Y, M and C are employed for printing, the matrix may generally be n×m (n and m are integer and n×m>3)

(Fourth Embodiment)

In the shown embodiment, high duty is provided for the mask for the Bk ink.

In the foregoing first embodiment, the Y, M, C, Bk inks are employed and the mask for generating the data for the printing quality improving liquid corresponding to respective color is set at 25% duty, respectively.

In the shown embodiment, a printing method not to print the Bk ink in overlapping manner to other Y, M, C inks, is employed, and the mask for the Bk ink is set independently of the masks for Y, M and C, for instance, the masks for the Y, M, C inks are set at 25% duty and, the mask for Bk ink may be set at 50%, 75% or 100% duty. In this case, the logical product of the mask for generating the data for the printing quality improving liquid for Y, M, C inks becomes zero.

Figure 9:
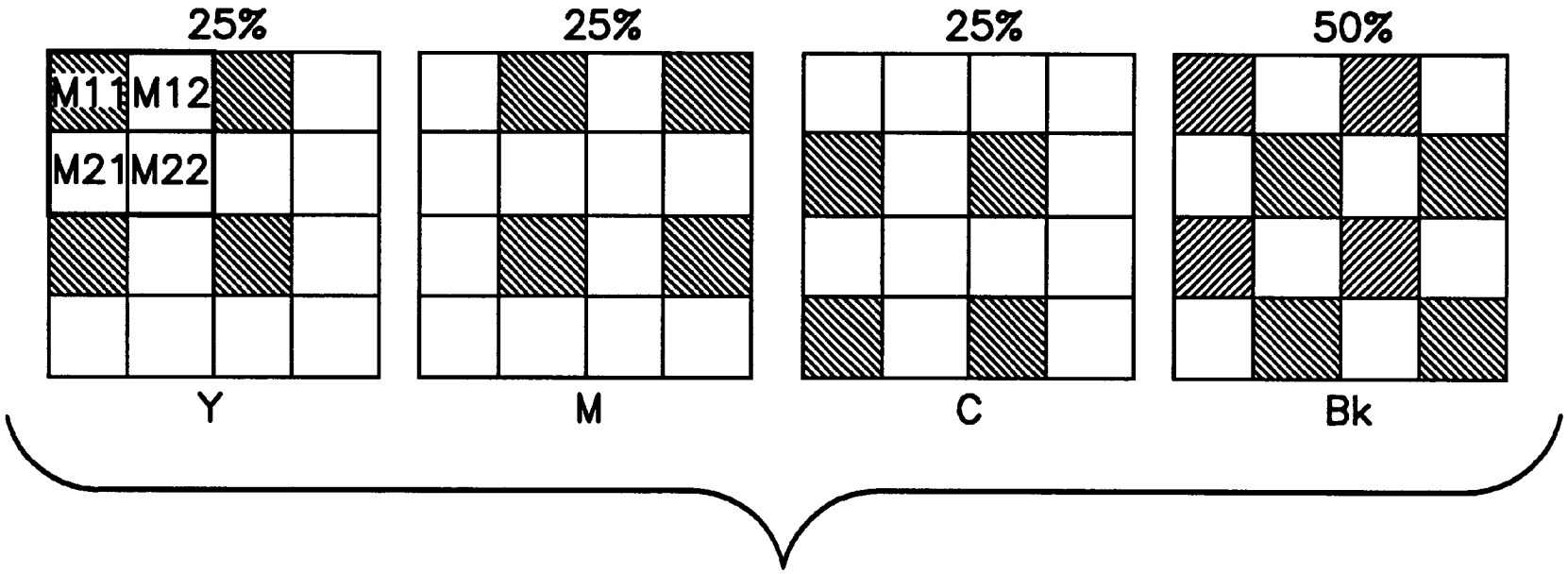
FIG. 9 is an illustration conceptually showing the mask in the case where an ejection duty of the printing quality improving liquid for Bk is 50%.

FIG. 9 shows an example where the duty of the mask for generating the printing quality improving liquid ejection data corresponding to the Bk ink is set at 50%.

This example is effective when the effect of the printing quality improving liquid for the Bk ink is emphasized. For example, in case that the water resistance of Bk is insufficient even at 99% of remaining ratio and is desired to achieve remaining ratio of 99.9%, such process is effective. As set forth above, in the case of the printing method where the Bk ink is never printed overlapping with other Y, M, C inks, or the printing employing only the Y, M, C inks, the logical product of the rank for generating the data for the printing quality improving liquid corresponding to respective of Y, M, C inks may be set to zero.

(Fifth Embodiment)

In each of the foregoing embodiments, the positions to hit by the printing quality improving liquid and ink droplets ejected from the S head and respective of Y, M, C and Bk heads are matched with each other. However, the application of the present invention should not be limited to this.

Figure 10:
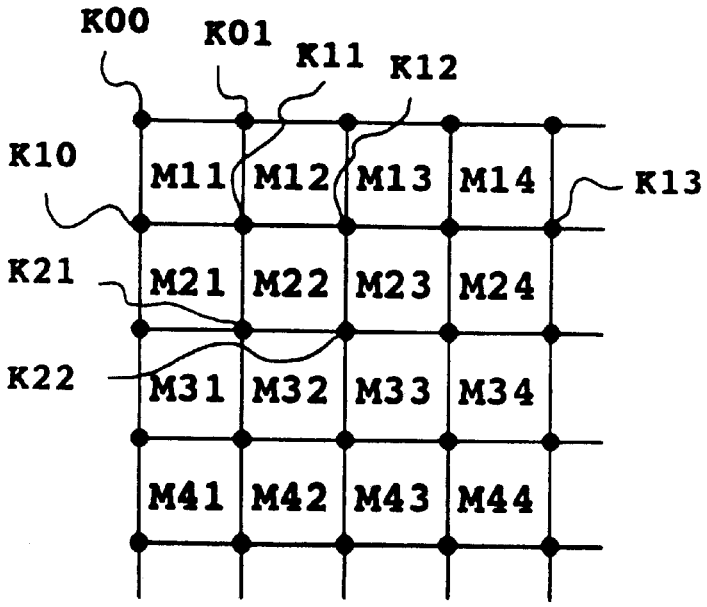
FIG. 10 is an illustration conceptually showing another embodiment of a printing quality improving liquid ejection data generating mask according to the invention.

FIG. 10 is a conceptual illustration for explanation of the mask in the case where an ejecting position of the printing quality improving liquid is shifted for half pitch of the pixels in primary and auxiliary scanning directions. Here, the ejection data of the printing quality improving liquid is shown by black circle.

For example, concerning Y ink, any one of among 2×2 matrix of M11, M12, M21 and M22 is ejection pixel, the ejection data of the printing quality improving liquid is set at K11. Next, any one of among 2×2 matrix of M13, M14, M23 and M24 is ejection pixel, the ejection data of the printing quality improving liquid is set at K13. Subsequently, in the similar manner, the data for printing quality improving liquid for Y ink is set sequentially. With respect to M ink, with paying attention for the matrix shifting right for one pixel relative to the Y ink, if any one of among 2×2 matrix of M12, M13, M22 and M23 is ejection pixel, the ejection data of the printing quality improving liquid is set at K12. Subsequently, in the similar manner, the data for printing quality improving liquid for M ink is set sequentially. With respect to C ink, if any one of among 2×2 matrix of M21, M22, M31 and M32 is ejection pixel, the ejection data of the printing quality improving liquid is set at K21. Subsequently, in the similar manner, the data for printing quality improving liquid for C ink is set sequentially. With respect to Bk ink, if any one of among 2×2 matrix of M22, M23, M32 and M33 is ejection pixel, the ejection data of the printing quality improving liquid is set at K22. Subsequently, in the similar manner, the data for printing quality improving liquid for Bk ink is set sequentially.

New effect by this method is enhancement of an effect in comparison with the first embodiment by improvement of the micro contact position between the printing quality improving liquid and the ink. In concrete, a position of K11 is a center position of M11, M12, M21 and M22, and the printing quality improving liquid ejected to K11 is uniformly effected to all of the inks of respective pixels of M11, M12, M21 and M22 to make micro reaction between the printing quality improving liquid and the ink better. Because the printing quality improving liquid is ejected to a center position of the matrix, the printing quality improving liquid is not ejected to positions corresponding to an outermost contour of an image.

Adjustment of an ejecting position of the printing quality improving liquid and the ink can be done by adjustment of the ejection timing in the primary scanning direction of the head, and by adjustment of the mounting positions of the head for the ink and the head for the printing quality improving liquid in the auxiliary scanning direction.

It should be noted that with respect to the printing quality improving liquid ejection data for the 0th row and 0th column, ejection or not is determined depending on the adjacent ejection data.

While an example where minimum printing pixel is shifted for half pitch in the primary scanning direction and in the auxiliary scanning direction in the shown embodiment, certain effect can be obtained even when the pixel is shifted only in the primary scanning direction, for example.

(Sixth Embodiment)

While the foregoing embodiment has been disclosed as examples, in which respective heads for Y, M, C are arranged in the auxiliary scanning direction, the application of the present invention should not be limited to this.

Figure 11:
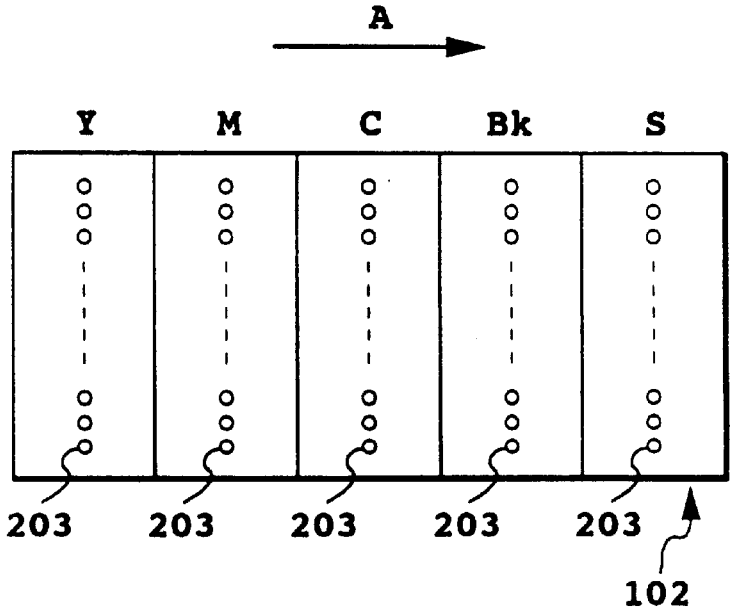
FIG. 11 is a diagrammatic illustration showing a construction of another head applicable for the present invention.

FIG. 11 is an illustration showing a construction of other heads. A number of the ejection openings of respective heads of Y, M, C and Bk are 160. Here, the head unit 102 performs primary scanning in the arrow A.

It should be noted that while in respective of foregoing embodiments, the printing quality improving liquid is ejected in advance of ejection of the ink, the effect of the present invention can be obtained even when the ink is ejected in advance of ejection of the printing quality improving liquid. On the other hand, the present invention is not limited to a construction where the head for the printing quality improving liquid and the head for ink are scanned by the same carriage, the present invention is applicable for the construction, in which the head for the printing quality improving liquid and the ink ejection head are scanned separately.

Furthermore, the printing apparatus is not limited to the serial type printing apparatus. The present invention is applicable for a full-line type printing apparatus by relatively shifting the printing medium.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Figure 12:
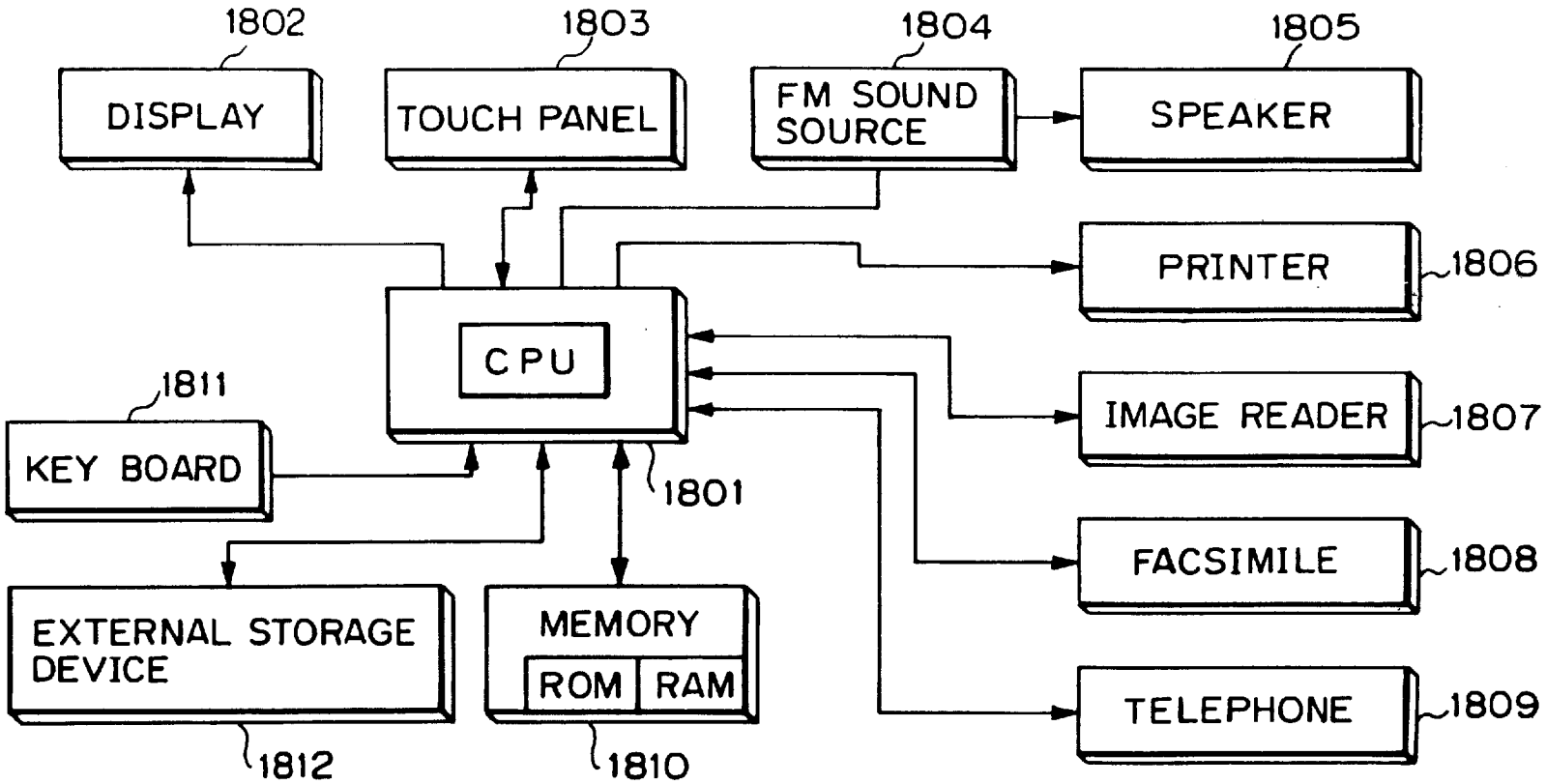
FIG. 12 is a block diagram showing one example of an information processing system employing each embodiment of the ink-jet printing apparatus.

FIG. 12 is a block diagram showing general construction of an information processing apparatus having a function of wordprocessor, personal computer, facsimile machine, a copy machine and so forth, to which the printing apparatus according to the present invention is applied.

In the drawings, a reference numeral 1801 denotes a control portion performing control of the overall apparatus, which includes CPU, such as microprocessor and so forth, and various I/O ports, to perform control for outputting control signal or data signal and so forth to respective portions and inputting control signal or data signal from the respective portions. A reference numeral 1802 denotes a display portion having a display screen, on which various menus, document information and images or so forth read by an image reader 1807 are displayed. A reference numeral 1803 denotes a transparent pressure sensitive touch panel provided on the display portion 1802 for performing item entry or coordinate portion entry on the display portion 1802 by depressing the surface thereof by a finger or so forth.

A reference numeral 1804 denotes an FM (frequency modulation) sound source portion which stores music information produced by a music editor and so forth in a memory portion 1810 or an external memory 1812 and performs FM modulation by reading out the stored music information from the memory portion or so forth. An electric signal from the FM sound source portion 1804 is transformed into an audible sound by a speaker portion 1805. A printer portion 1806 is employed as an output terminal of the wordprocessor, the personal computer, the facsimile machine, the copy machine and so forth, in which the printing apparatus according to the present invention is applied.

A reference numeral 1807 denotes an image reader portion for optoelectrically reading out an original data for inputting, which is located at the intermediate position in an original feeding path and performs reading out various original documents, such as original document for facsimile machine or copy machine. A reference numeral 1808 denotes a facsimile (FAX) transmission and reception portion for transmitting original data read by the image reader portion or for receiving transmitted facsimile signal, which facsimile transmission and reception portion has an external interface function. A reference numeral 1809 denotes a telephone machine portion having a normal telephone function and various associated functions, such as a recording telephone and so forth.

A reference numeral 1810 denotes a memory portion including a ROM storing a system program, a manager program, other application programs and so forth, as well as character fonts, dictionary and so forth, a RAM for storing application program loaded from an external storage device 1812, document information, video information and so forth.

A reference numeral 1811 denotes a keyboard portion inputting document information or various commands. A reference numeral 1812 denotes the external storage device employing a floppy disk or hard disk drive as storage medium. In the external storage device 1812, document information, music or speech information, application programs of the user and so forth are stored.

Figure 13:
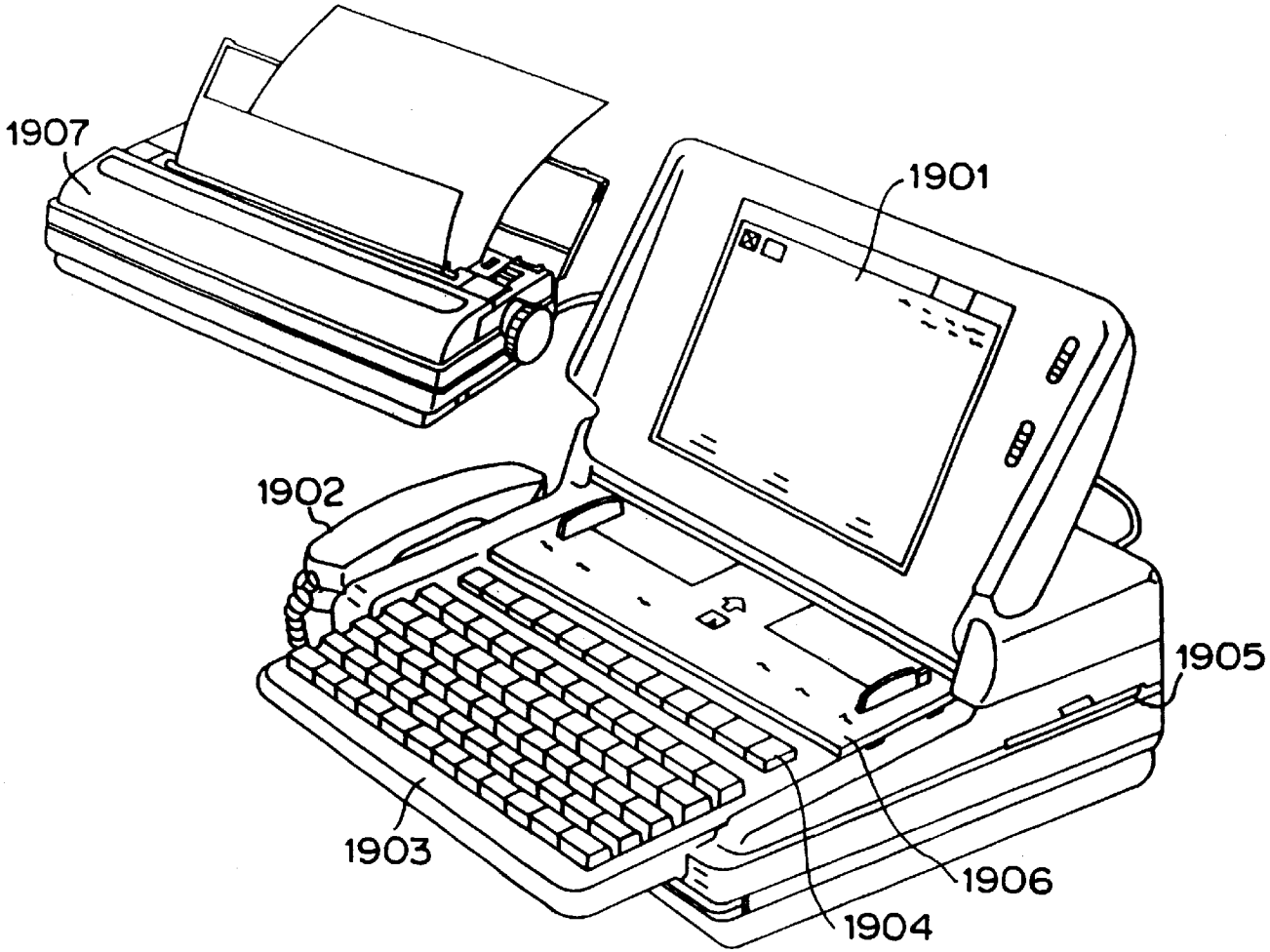
FIG. 13 is a perspective view showing external appearance of the system set forth above.

FIG. 13 is a diagrammatic external view of the information processing system shown in FIG. 12.

In FIG. 13, a reference numeral 1901 denotes a flat panel display utilizing a liquid crystal and so forth. On this display, the touch panel 1803 is overlaid so that coordinate position input or item designation input can be performed by depressing the surface of the touch panel 1803 by a finger or so forth. A reference numeral 1902 denotes a handset to be used when a function as the telephone machine of the apparatus is used. A keyboard is detachably connected to a main body of the apparatus through a cable and adapted to permit entry of various document information or various data input. On the other hand, on the keyboard 1903, various function keys and so forth are arranged. A reference numeral 1905 denotes an insertion mouth of the external storage device 1812 for accommodating a floppy disk inserted thereinto.

A reference numeral 1906 denotes a paper stacking portion for stacking the original to be read by the image reader portion 1807. The original read by the image reader portion is discharged from the back portion of the apparatus. On the other hand, in facsimile reception, the received information is printed by the ink-jet printer 1907.

It should be noted that while the display portion 1802 may be a CRT, it is desirable to employ a flat display panel, such as a liquid crystal display employing a ferrodielectric liquid crystal for capability of down-sizing and reduction of thickness as well as reduction of weight.

When the information processing apparatus as set forth is operated as the personal computer or the wordprocessor, various information input through the keyboard portion 1811 is processed according to a predetermined program by the control portion 1801 and output as printed image by the printer portion 1806.

When the information processing apparatus is operated as a receiver of the facsimile machine, facsimile information input from the FAX transmission and reception portion 1808 via a communication network is subject to reception process according to the predetermined program and output as received image by the printer portion 1808.

In addition, when the information processing apparatus is operated as a copy machine, the original is read by the image reader portion 1807 and the read original data is output to the printer portion as copy image via the control portion 1801. It should be noted that, when the information processing apparatus is used as the transmitter of the facsimile machine, the original data read by the image reader 1807 is processed for transmission according to the predetermined program by the control portion, and thereafter transmitted to the communication network via the FAX transmission and reception portion 1808.

Figure 14:
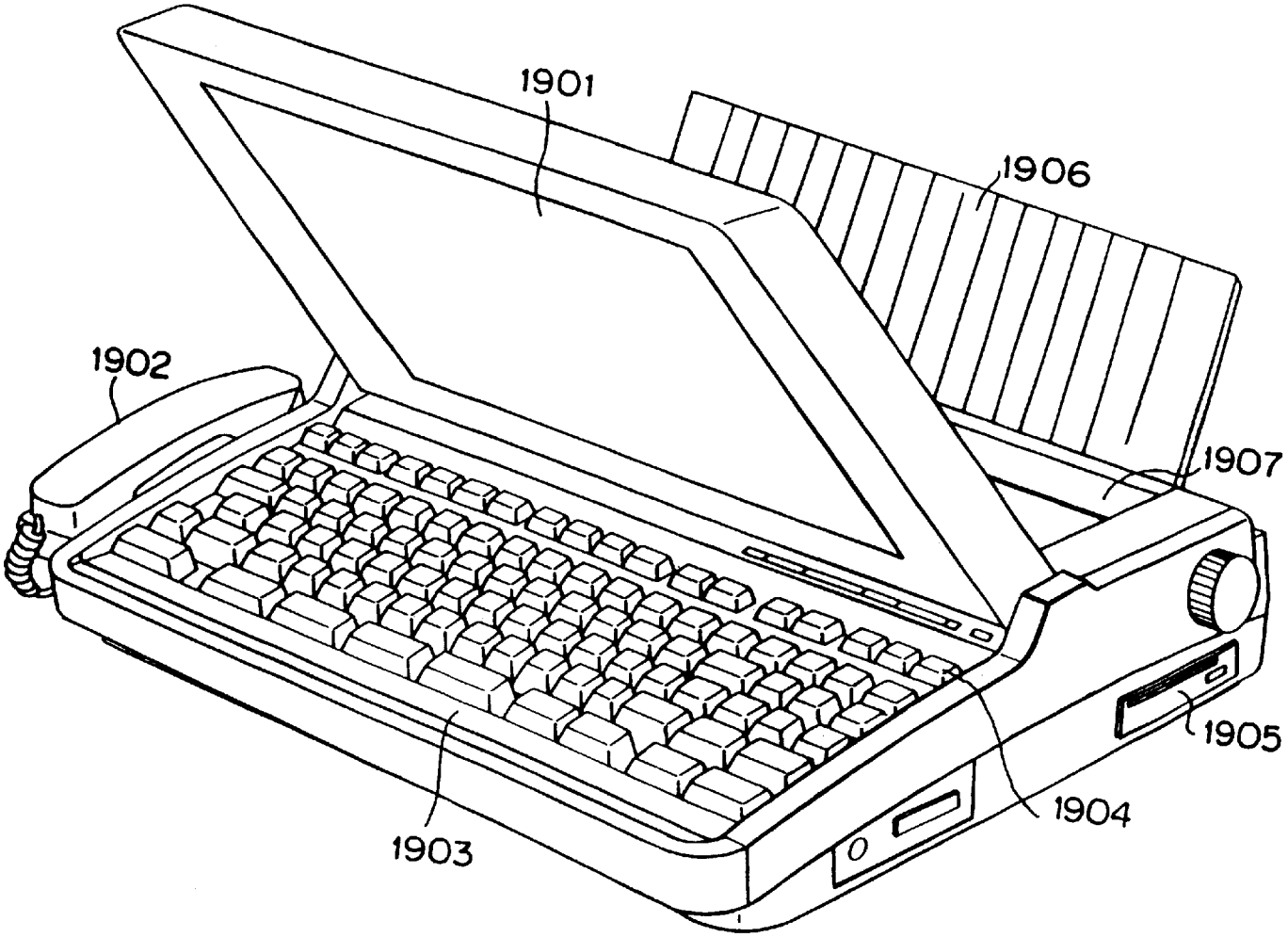
FIG. 14 is a perspective view showing external appearance showing another example of the system.

It should be noted that the information processing apparatus may be an integrated type incorporating the ink-jet printer within a main body as illustrated in FIG. 14. In this case, portability can be further improved. In FIG. 14, the portions having the same function to FIG. 13 are shown with the corresponding reference numerals.

As set forth above, a multi-function type information processing apparatus may obtain high quality printed image at high speed and low noise by employing the printing apparatus of the present invention. Therefore, the functions of the information processing apparatus can be further enhanced.

As can be appreciated from the discussion given hereabove, according to the present invention, when the printing quality improving liquid and the ink are ejected from the printing quality improving liquid ejection head and the ink ejection heads and the printing quality improving liquid and inks are contacted and mixed on the printing medium, the printing quality improving liquid and the ink are ejected at ejection interval with the predetermined period. Therefore, before one of the printing quality improving liquid and the ink is penetrated or absorbed in the printing medium, the other is mixed.

As a result, the coloring agent of the ink can be certainly made insoluble or coagulated to improve water-resistance and to obtain high quality printing with lesser bleeding.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. An ink-jet printing apparatus for performing printing on a printing medium employing an ink and a printing quality improving liquid for making the ink insoluble or coagulated, said apparatus comprising:

an ejection controller for controlling said apparatus to eject the printing quality improving liquid and the ink on a substantially same position or adjacent positions on the printing medium for mutually contacting with each other on the printing medium, at different timings, so that an amount of the printing quality improving liquid ejected to a unit area of the printing medium is less than an amount of the ink ejected to the unit area, a time interval between timing for ejection of said printing quality improving liquid and timing for ejection of said ink being set within 200 msec during which at least part of one of said printing quality improving liquid and ink which is ejected at an earlier timing remains on a surface of the printing medium.

2. An ink-jet printing apparatus as claimed in claim 1, further comprising a shifting device for relatively shifting a printing quality improving liquid ejecting portion for ejecting the printing quality improving liquid and an ink ejecting portion for ejecting the ink to the printing medium, said ejection controller controlling relative shifting of said shifting device and respective ejecting of the printing quality improving liquid and the ink from said printing quality improving liquid ejecting portion and said ink ejecting portions, so as to set said time interval within said 200 msec.

3. An ink-jet printing apparatus as claimed in claim 2, wherein said shifting device has first and second scanning devices for scanning said printing quality improving liquid ejecting portion and said ink ejecting portion along a predetermined region of the printing medium.

4. An ink-jet printing apparatus as claimed in claim 3, wherein said shifting device is integrally formed.

5. An ink-jet printing apparatus as claimed in claim 2, wherein said shifting device has a scanning device for integrally scanning said printing quality improving liquid ejecting portion and said ink ejecting portion along a predetermined region of the printing medium.

6. An ink-jet printing apparatus as claimed in claim 2, wherein said ink ejecting portion has a plurality of ink ejecting sections each ejecting a different kind of ink, respectively, said ejection controller controlling the shifting of said shifting device and controlling ejecting of the printing quality improving liquid from said printing quality improving liquid ejecting portion within said 200 msec during which at least part of one of said printing quality improving liquid and ink ejected at the earlier timing remains on the surface of the printing medium.

7. An ink-jet printing apparatus as claimed in claim 4, wherein said 200 msec during which at least part of one of said printing quality improving liquid and ink ejected at the earlier timing remains on a surface of the printing medium is a period during which a same shifting of said printing quality improving liquid ejecting portion and said ink ejecting portion is performed by the integrally formed shifting device.

8. An ink-jet printing apparatus as claimed in claim 5, wherein an ejection interval between ejection from said printing quality improving liquid ejecting portion and ejection from said ink ejecting portion is a constant period within said 200 msec during which at least part of one of said printing quality improving liquid and ink ejected at the earlier timing remains on the surface of the printing medium.

9. An ink-jet printing apparatus as claimed in claim 8, wherein said ejecting controller controls said apparatus to cause said printing quality improving liquid ejecting portion and said ink ejecting portion to eject the printing quality improving liquid and the ink with the ejection interval within the period during scanning of said printing quality improving liquid ejecting portion and said ink ejecting portion by a scanning device.

10. An ink-jet printing apparatus as claimed in claim 9, wherein said ejection controller generates one ejection data signal of said printing quality improving liquid ejecting portion on a basis of a plurality of ejection data signals of said ink ejecting portion corresponding to a unit pixel group comprising a given number of pixels.

11. An ink-jet printing apparatus as claimed in claim 10, wherein said ink ejecting portion comprises a plurality of ink ejecting sections respectively ejecting a plurality of kinds of inks, and said ejection controller generates one ejection data signal for said printing quality improving liquid ejection portion with respect to each of the plurality of kinds of inks.

12. An ink-jet printing apparatus as claimed in claim 11, wherein said ejection controller generates the ejection data signals for said printing quality improving liquid ejecting portion per each of the plurality of kinds of inks.

13. An ink-jet printing apparatus as claimed in claim 2, wherein the printing quality improving liquid includes a cation material of a low molecular weight component and a high molecular weight component, and the ink contains anion type dye.

14. An ink-jet printing apparatus as claimed in claim 2, wherein the printing quality improving liquid includes a cation material of a low molecular weight component and a high molecular weight component, and the ink contains an anion type compound and a pigment.

15. An ink-jet printing apparatus as claimed in claim 2, wherein said printing quality improving liquid ejecting portion and said ink ejecting portion respectively generates bubbles in the printing quality improving liquid and the ink utilizing thermal energy and ejects the printing quality improving liquid and the ink based on generation of the bubbles.

16. An ink-jet printing apparatus as claimed in claim 2, wherein a period during which at least part of one of said printing quality improving liquid and said ink ejected at the earlier timing remains on the surface of the printing medium is 2000 msec.

17. An ink-jet printing apparatus as claimed in claim 2, wherein a period during which at least part of one of said printing quality improving liquid and said ink ejected at the earlier timing remains on the surface of the printing medium is 1500 msec.

18. An ink-jet printing apparatus as claimed in claim 2, wherein a period during which at least part of one of said printing quality improving liquid and said ink ejected at the earlier timing remains on the surface of the printing medium is 1000 msec.

19. An ink-jet printing apparatus as claimed in claim 2, wherein said period during which at least part of one of said printing quality improving liquid and said ink ejected at the earlier timing remains on the surface of the printing medium is 200 msec.

20. An ink-jet printing apparatus for performing printing on a printing medium employing an ink and a printing quality improving liquid for making the ink insoluble or coagulated, said apparatus comprising:

an ejection controller for controlling ejecting of the printing quality improving liquid and the ink at a substantially same position or adjacent positions on the printing medium for mutually contacting each other, so that an amount of the printing quality improving liquid ejected to a unit area of the printing medium is less than an amount of the ink ejected to the unit area, a time interval between timing for ejection of the printing quality improving liquid and timing for ejection of the ink being less than or equal to 200 msec.

21. An ink-jet printing method for performing printing on a printing medium employing an ink and a printing quality improving liquid for making the ink insoluble or coagulated, wherein the printing quality improving liquid is ejected at a position on the printing medium and the ink is ejected at a position on the printing medium, said method comprising the steps of:

ejecting the printing quality improving liquid and the ink at a substantially same position or adjacent positions on the printing medium for mutually contacting each other so that an amount of the printing quality improving liquid ejected to a unit area of the printing medium is less than an amount of the ink ejected to the unit area; and controlling a time interval between timing for ejection of the printing quality improving liquid and timing for ejection of the ink to be less than or equal to 200 msec.

22. An ink-jet printing method for performing printing by supplying an ink to a printing medium, comprising the steps of:

providing an ink ejecting portion for ejecting the ink and a printing quality improving liquid ejecting portion for ejecting a printing quality improving liquid which makes a coloring agent in said ink insoluble or coagulated;

generating one ejection data signal for said printing quality improving liquid ejecting portion on a basis of a plurality of ejection data signals for said ink ejecting portion for forming a unit pixel group comprising a given number of pixels; and forming said unit pixel group by ejecting the ink and the printing quality improving liquid from said ink ejecting portion and said printing quality improving liquid ejecting portion, respectively, on a basis of respective data signals of said plurality of ejection data signals and said one ejection data signal, wherein an amount of the printing quality improving liquid ejected to a unit area of the printing medium is less than an amount of ink ejected to the unit area and a time interval between timing for ejection of said printing quality improving liquid and timing for ejection of said ink is set within 200 msec.

23. An ink-jet printing method for performing printing on a printing medium employing an ink and a printing quality improving liquid for making the ink insoluble or coagulated, said method comprising the steps of:

ejecting the ink at a first position for forming a pixel; and ejecting the printing quality improving liquid at a second position, wherein the first position to which the ink is ejected is different from the second position to which the printing quality improving liquid is ejected, and wherein the second position to which the printing quality improving liquid is ejected is two-dimensionally shifted for ½ of a pitch between adjacent pixels from the first position to which the ink is ejected, and the printing quality improving liquid is not ejected to positions corresponding to an outermost contour of an image, and an amount of the printing quality improving liquid ejected to a unit area of the printing medium is less than an amount of ink ejected to the unit area.

24. An ink-jet printing method for performing printing on a printing medium employing an ink and a printing quality improving liquid for making the ink insoluble or coagulated, wherein the printing quality improving liquid is ejected at a position on the printing medium and the ink is ejected at a position on the printing medium, said method comprising the steps of:

ejecting the printing quality improving liquid and the ink at a substantially same position or adjacent positions on the printing medium for mutually contacting each other so that an amount of the printing quality improving liquid ejected to a unit area of the printing medium is less than an amount of the ink ejected to the unit area; and controlling a time interval between timing for ejection of the printing quality improving liquid and timing for ejection of the ink to be less than or equal to 200 msec during which the ink and the printing quality improving liquid contact each other in a condition that said ink and the printing quality improving liquid are in a liquid state.

25. An ink-jet printing method for performing printing on a printing medium employing an ink and a printing quality improving liquid for making the ink insoluble or coagulated, wherein the printing quality improving liquid is ejected at a position on the printing medium and the ink is ejected at a position on the printing medium, said method comprising the steps of:

ejecting the printing quality improving liquid and the ink at a substantially same position or adjacent positions on the printing medium for mutually contacting each other so that an amount of the printing quality improving liquid ejected to a unit area of the printing medium is less than an amount of the ink ejected to the unit area; and controlling a time interval between timing for ejection of the printing quality improving liquid and timing for ejection of the ink to be less than or equal to 200 msec during which the ink and the printing quality improving liquid contact each other in a condition that said ink and said printing quality improving liquid have not completely penetrated into the printing medium.

26. An ink-jet printing method for performing printing on a printing medium employing an ink and a printing quality improving liquid for making the ink insoluble or coagulated, wherein the printing quality improving liquid is ejected at a position on the printing medium and the ink is ejected at a position on the printing medium, said method comprising the steps of:

ejecting the printing quality improving liquid and the ink at a substantially same position or adjacent positions on the printing medium for mutually contacting each other so that an amount of the printing quality improving liquid ejected to a unit area of the printing medium is less than an amount of the ink ejected to the unit area; and controlling a time interval between timing for ejection of the printing quality improving liquid and timing for ejection of the ink to be less than or equal to 200 msec during which the ink and the printing quality improving liquid react and whereby said ink is retained on a predetermined region of the printing medium.

27. An ink-jet printing method for performing printing on a printing medium employing an ink and a printing quality improving liquid for making the ink insoluble or coagulated, wherein the printing quality improving liquid is ejected at a position on the printing medium and the ink is ejected at a position on the printing medium, said method comprising the steps of:

ejecting the printing quality improving liquid and the ink at a substantially same position or adjacent positions on the printing medium for mutually contacting each other so that an amount of the printing quality improving liquid ejected to a unit area of the printing medium is less than an amount of the ink ejected to the unit area; and controlling a time interval between timing for ejection of the printing quality improving liquid and timing for ejection of the ink to be less than or equal to 200 msec during which the ink and the printing quality improving liquid are mixed on the printing medium.

28. An image forming system comprising:

(a) an ink-jet printing apparatus for performing printing on a printing medium employing an ink and a printing quality improving liquid for making the ink insoluble or coagulated, said apparatus comprising an ejection controller for controlling said apparatus to eject the printing quality improving liquid and the ink on a substantially same position or adjacent positions on the printing medium, for mutually contacting each other on the printing medium, at different timings, so that an amount of the printing quality improving liquid ejected to a unit area of the printing medium is less than an amount of the ink ejected to the unit area, a time interval between a timing for ejection of said printing quality improving liquid and a timing for ejection of said ink being set within 200 msec during which at least part of one of said printing quality improving liquid and ink ejected at the earlier timing remains on a surface of the printing medium; and (b) a communication device for receiving image data to be used in said ink-jet printing apparatus from an external device.

29. An image forming system comprising:

(a) an ink-jet printing apparatus for performing printing on a printing medium employing an ink and a printing quality improving liquid for making the ink insoluble or coagulated, said apparatus comprising an ejection controller for controlling said apparatus to eject the printing quality improving liquid and the ink on a substantially same position or adjacent positions on the printing medium for mutually contacting each other on the printing medium, at different timings, so that an amount of the printing quality improving liquid ejected to a unit area of the printing medium is less than an amount of the ink ejected to the unit area, a time interval between a timing for ejection of said printing quality improving liquid and a timing for ejection of said ink being set within 200 msec during which at least part of one of said printing quality improving liquid and ink ejected at an earlier timing remains on a surface of the printing medium; and (b) a supply device for supplying image data to said ink-jet printing apparatus.

30. An image forming system comprising:

(a) an ink-jet printing apparatus for performing printing on a printing medium employing an ink and a printing quality improving liquid for making the ink insoluble or coagulated, said apparatus comprising an ejection controller for controlling said apparatus to eject the printing quality improving liquid and the ink on a substantially same position or adjacent positions on the printing medium for mutually contacting each other on the printing medium, at different timings, so that an amount of the printing quality improving liquid ejected to a unit area of the printing medium is less than an amount of the ink ejected to the unit area, a time interval between a timing for ejection of said printing quality improving liquid and a timing for ejection of said ink being set within 200 m sec during which at least part of one of said printing quality improving liquid and ink ejected at an earlier timing remains on a surface of the printing medium; and (b) a reading device for reading an original image to be printed by said ink-jet printing apparatus.

* * * * *

UNITED STATES PATENT AND TRADEMARK OFFICE

CERTIFICATE OF CORRECTION

PATENT NO. : 6,264,320 B1
DATED : July 24, 2001
INVENTOR(S) : Moriyama et al.

It is certified that error appears in the above-identified patent and that said Letters Patent is hereby corrected as shown below:

Title page,Item [56] References Cited,
U.S. PATENT DOCUMENTS, "Hacklemar et al." should read -- Hackleman et al. --
FOREIGN PATENT DOCUMENTS, "299971 7/1988 (JP)" should be deleted.

Column 1,
Line 39, "case." should read -- cases. --.

Column 2,
Line 25, "has" should read -- has been --.
Line 39, "the" should be deleted.

Column 9,
Line 31, "two-dotted" should read -- the two-dotted --.

Column 10,
Line 5, "processes" should read -- process --.

Column 11,
Line 9, "form" should read -- from --.

Column 12,
Line 32, "ink. Shorter" should read -- ink, a shorter --.

Column 14,
Line 16, "not equal." should read -- unequal. --.
Lines 17 and 43, "such" should read -- such a --.
Lines 27, 29, 30, 31, 34 and 35, "hitted" should read -- hit --.
Lines 28 and 32, "hitted" should read -- hit -- (both occurrences).
Line 42, "wait" should read -- await --.

Column 15,
Line 42, "the" should be deleted.

Column 16,
Line 48, "mask." should read -- masks. --.

UNITED STATES PATENT AND TRADEMARK OFFICE

CERTIFICATE OF CORRECTION

PATENT NO. : 6,264,320 B1
DATED : July 24, 2001
INVENTOR(S) : Moriyama et al.

It is certified that error appears in the above-identified patent and that said Letters Patent is hereby corrected as shown below:

Column 17,
Line 4, "such" should read -- such a --.

Column 18,
Line 11, "ability" should read -- ability into --.

Column 20,
Line 48, "agueous" should read -- aqueous --.
Line 63, "in" should read -- is --.
Line 66, "here," should read -- Here, --.

Column 23,
Line 32, "respective of" should read -- the respective --.

Column 25,
Line 9, "temperature adjusted" should read -- temperature-adjusted --.

Signed and Sealed this

Fifth Day of March, 2002

*Attest:*

*Attesting Officer*

JAMES E. ROGAN
*Director of the United States Patent and Trademark Office*